US012729939B2

(12) United States Patent
Cohen

(10) Patent No.: US 12,729,939 B2
(45) Date of Patent: Sep. 8, 2026

(54) WARHEAD FOR INTERCEPTOR

(71) Applicant: David Cohen, Herzliya (IL)

(72) Inventor: David Cohen, Herzliya (IL)

( * ) Notice: Subject to any disclaimer, the term of this patent is extended or adjusted under 35 U.S.C. 154(b) by 0 days.

(21) Appl. No.: 18/563,889

(22) PCT Filed: May 25, 2021

(86) PCT No.: PCT/IL2021/050619

§ 371 (c)(1),
(2) Date: Nov. 23, 2023

(87) PCT Pub. No.: WO2022/249161

PCT Pub. Date: Dec. 1, 2022

(65) Prior Publication Data

US 2024/0240924 A1 Jul. 18, 2024

(51) Int. Cl.

| | |
|---|---|
| ***F42B 12/20*** | (2006.01) |
| ***F42B 12/22*** | (2006.01) |
| ***F42C 19/095*** | (2006.01) |

(52) U.S. Cl.

CPC ..... *F42B 12/205* (2013.01); *F42B 12/22* (2013.01); *F42C 19/095* (2013.01)

(58) Field of Classification Search

CPC ..... F42B 12/205; F42B 12/20; F42B 12/201; F42B 12/207; F42B 12/208; F42B 12/22; F42B 12/24; F42B 12/26; F42B 12/28; F42B 12/30; F42B 12/32; F42C 19/095

USPC ..... 102/506

See application file for complete search history.

(56) References Cited

U.S. PATENT DOCUMENTS

| | | | | |
|---|---|---|---|---|
| 3,949,674 | A * | 4/1976 | Talley | F42B 12/60 102/497 |
| 4,406,227 | A * | 9/1983 | Beeker | F42B 12/70 102/393 |
| 4,455,943 | A * | 6/1984 | Pinson | F42B 12/58 102/393 |
| 4,655,139 | A * | 4/1987 | Wilhelm | F42C 19/095 102/494 |
| 4,848,239 | A * | 7/1989 | Wilhelm | F42C 13/02 102/475 |
| 6,279,478 | B1 * | 8/2001 | Ringer | F42B 12/24 102/213 |
| 2004/0011238 | A1 * | 1/2004 | Ronn | F42B 12/32 102/492 |
| 2010/0199875 | A1 * | 8/2010 | Weihrauch | F42B 12/204 102/497 |
| 2012/0192752 | A1 * | 8/2012 | Lloyd | F42C 19/095 102/478 |

(Continued)

FOREIGN PATENT DOCUMENTS

| | | |
|---|---|---|
| JP | 2008-537085 | 9/2008 |
| RU | 2249175 | 3/2005 |

(Continued)

OTHER PUBLICATIONS

International Preliminary Report on Patentability Dated Dec. 7, 2023 From the International Bureau of WIPO Re. Application No. PCT/IL2021/050619. (8 Pages).

(Continued)

*Primary Examiner* — John Cooper

(57) ABSTRACT

A warhead comprises an outer shell of explosive surrounding an inner core of fragmentation material.

15 Claims, 34 Drawing Sheets

(56) References Cited

U.S. PATENT DOCUMENTS

2016/0025468 A1* 1/2016 Botthof ..... F42B 12/32
102/475

FOREIGN PATENT DOCUMENTS

WO WO 2006/137949 12/2006
WO WO 2022/249161 12/2022

OTHER PUBLICATIONS

International Search Report and the Written Opinion Dated Sep. 5, 2021 From the International Searching Authority Re. Application No. PCT/IL2021/050619. (14 Pages).
Supplementary European Search Report and the European Search Opinion Dated Mar. 10, 2025 From the European Patent Office Re. Application No. 21942874.5. (11 Pages).
Notice of Reason(s) for Rejection Dated Jun. 3, 2025 From the Japan Patent Office Re. Application No. 2023-572849 and Its Translation Into English. (12 Pages).
Notice of Reason(s) for Rejection Dated Dec. 16, 2025 From the Japan Patent Office Re. Application No. 2023-572849 and Its Translation Into English. (7 Pages).
Notice of Reason(s) for Rejection Dated Jun. 30, 2026 From the Japan Patent Office Re. Application No. 2023-572849 and Its Translation Into English. (5 Pages).

* cited by examiner

WARHEAD FOR INTERCEPTOR

RELATED APPLICATIONS

This application is a National Phase of PCT Patent Application No. PCT/IL2021/050619 having International filing date of May 25, 2021.

PCT Patent Application No. PCT/IL2021/050619 is also related to Israel Patent Application No. 274639 filed on May 13, 2020.

The contents of the above applications are all incorporated by reference as if fully set forth herein in their entirety.

FIELD AND BACKGROUND OF THE INVENTION

The present invention relates to warheads, and more particularly but not 15 exclusively to warheads for air-to-air missiles, especially for interception of aircraft and missiles.

Reference is made to FIG. 1, which shows an interceptor missile that is on course to intercept hostile missile 12. Generally, such interceptors do not actually hit their targets but explode in the vicinity so that the blast and fragments destroy or damage the hostile missile.

As shown in FIG. 2, interceptor missile 10 explodes in proximity to its target, and the blast and fragments 14 spread out in all directions. As a result, only about 20% of the energy of the blast takes part in the interception, and the remainder of the energy is wasted.

FIG. 3 is a cutaway view of interceptor missile 10, showing the warhead 20.

Layers of fragments 22 surround a central core 24 of high explosive and when in proximity to the hostile warhead, the central core explodes. The blast and fragments expand outwardly in all directions. Again, most of the fragments are directed away from the target, making the interception process wasteful, and requiring large interceptors that can do the task despite the waste.

The lethality of a warhead used for interception is limited by the weight and volume of the warhead, and the high speeds and maneuverability needed for interception limit the ability to increase the size of the warhead. Thus in many cases two or more interceptors may be needed for a single target.

SUMMARY OF THE INVENTION

The present embodiments may provide a warhead for a missile, particularly an interceptor missile, in which the explosive is placed in separately detonatable units around the periphery of a central core made up of fragmentation particles. The units of explosive are detonated in controllable manner to direct the particles in the appropriate direction to maximize hit probability and consequent damage to the missile. Thus if a target is below the interceptor, then the explosive units on the upper side of the interceptor away from the target are detonated to direct the fragments of the core downwards towards the missile.

A unit of explosive may also be placed behind the core for the case where the target is directly in front of the warhead. The explosive units may be in layers or rings along the length of the warhead, so that different rings may be detonated one after the other. In this way the interceptor missile may be used against a swarm of drones or the like.

The units may provide a way to control the detonation so that a focused cloud of particles may be generated. Thus the amount of energy reaching the target is maximized.

According to an aspect of some embodiments of the present invention there is provided a warhead comprising an outer shell of explosive surrounding an inner core of fragmentation material.

In an embodiment, the outer shell comprises at least one ring of separately detonatable explosive units. An embodiment may comprise a controller that selects between the separately detonatable explosive units for detonation. The idea is to select specific sides of the core to detonate to provide a directed fragmentation cloud that goes away from the detonation.

In an embodiment, the outer shell comprises at least two rings of separately detonatable explosive units. Alternatively or additionally, the outer shell comprises three, four, five or more rings of separately detonatable explosive units.

The separate rings may be detonated in succession, so as to provide a shaped fragmentation cloud.

In an embodiment, at least some of the separately controllable explosive units have a concave outer wall.

In an embodiment, at least some of the separately controllable explosive units have a concave inner wall.

An embodiment may comprise a separately detonatable backplate, the backplate being located behind the inner core to generate a fragmentation cloud in a forward direction.

The backplate may have a concave surface towards the inner core.

The warhead may be carried in an aerial interceptor missile. The missile may be for intercepting aircraft including drones, and swarms of drones and other missiles.

According to a further aspect of the present invention there is provided a method of interception of a target comprising:

approaching into proximity with the target;

determining a direction in which a weighting of the target as detected by sensors is greater;

and causing an explosion in the direction.

In an embodiment, the explosion provides a directed fragmentation cloud.

The method may comprise directing the fragmentation cloud by selecting for detonation a predetermined set of explosive units from a full set of explosive units disposed around a fragmentation core.

In an embodiment, the full set of explosive units comprises a ring angularly disposed around the fragmentation core.

In an embodiment, the full set of explosive units comprises at least two rings disposed around the fragmentation core, the method comprising detonating the rings successively to shape the fragmentation cloud.

In an embodiment, the full set of explosive units comprises at least five rings successively disposed around the fragmentation core, the method comprising detonating each ring successively.

The method may be used against a swarm of drones.

According to a third aspect of the present invention there is provided a warhead comprising an outer shell of fragmentation material surrounding an inner ring of detonators.

In an embodiment, the inner ring comprises separately detonatable explosive units.

Embodiments may comprise a controller configured to select one or more of the separately detonatable explosive units for detonation, thereby to provide a directed fragmentation cloud.

In an embodiment, the inner shell comprises at least two rings of separately detonatable explosive units.

In an embodiment, the inner shell comprises at least five rings of separately detonatable explosive units.

In an embodiment, the rings are controllable to explode in succession, thereby to provide a shaped fragmentation cloud.

In an embodiment, at least some of the separately controllable explosive units are separated by spacers.

In an embodiment, the spacers comprise energy absorbent material.

Embodiments may include one or more backplates to separate the warhead into independently detonatable segments.

Embodiments may comprise at least two rings of separately explodable units and having an additional backplate separating the fragmentation shell between each ring.

In embodiments, at least some of the backplates comprise an energy-absorbing wall.

In embodiments, the fragmentation shell comprises a plurality of shaped particles.

The controller may select explodable units for detonation that are on an opposite side of the warhead from the target, thereby to launch fragments of the fragmentation shell into a path of the target.

The warhead may have an inner core of high explosive within the ring of detonators.

The warhead may comprise one or more baffles within the inner core of high explosive.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 23 is a simplified diagram that illustrates a shell of separately detonatable explosive units according to an embodiment of the present invention, which shell may be placed around a 15 fragmentation core or the like;

Figure 31:
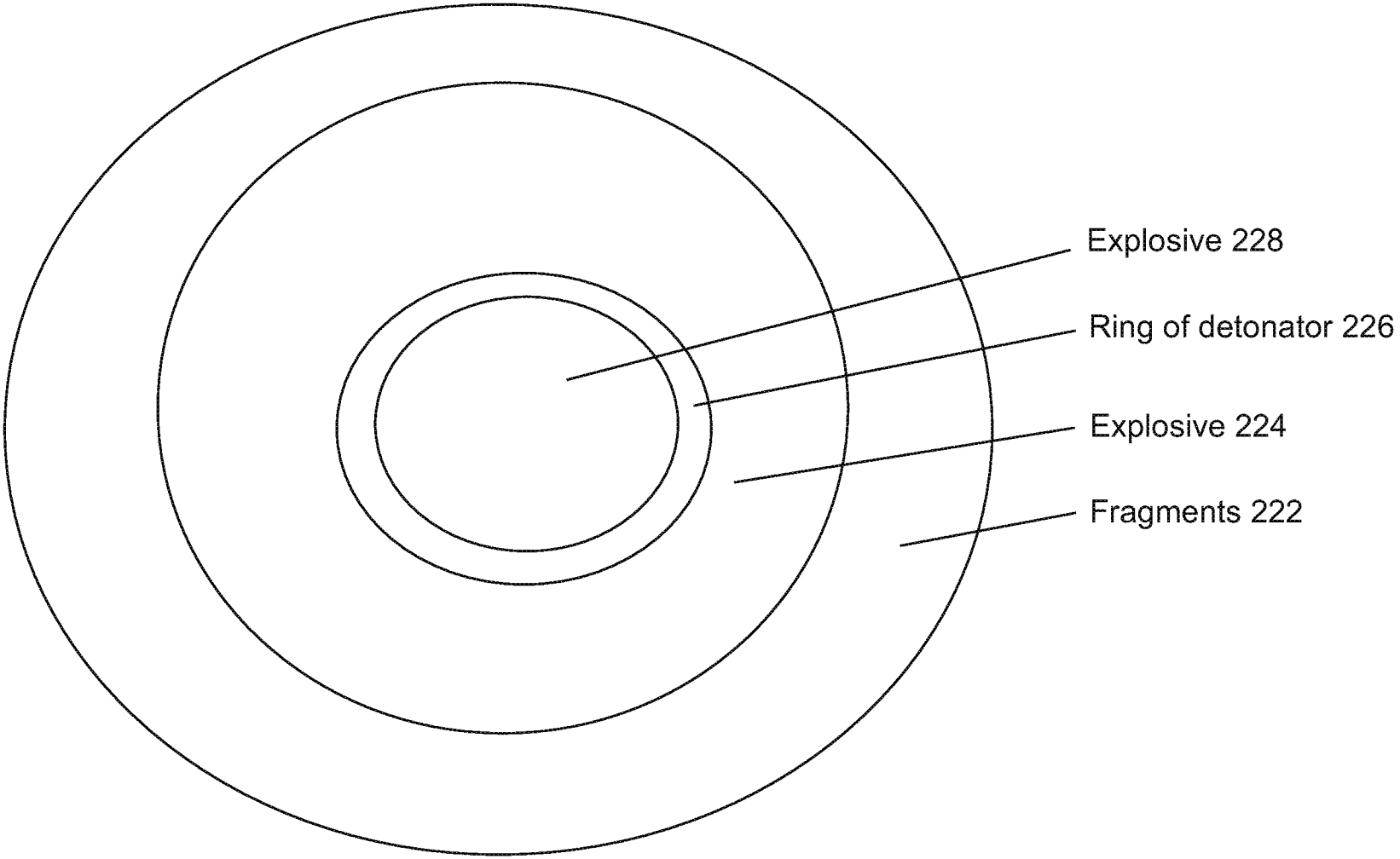
Figure 32:
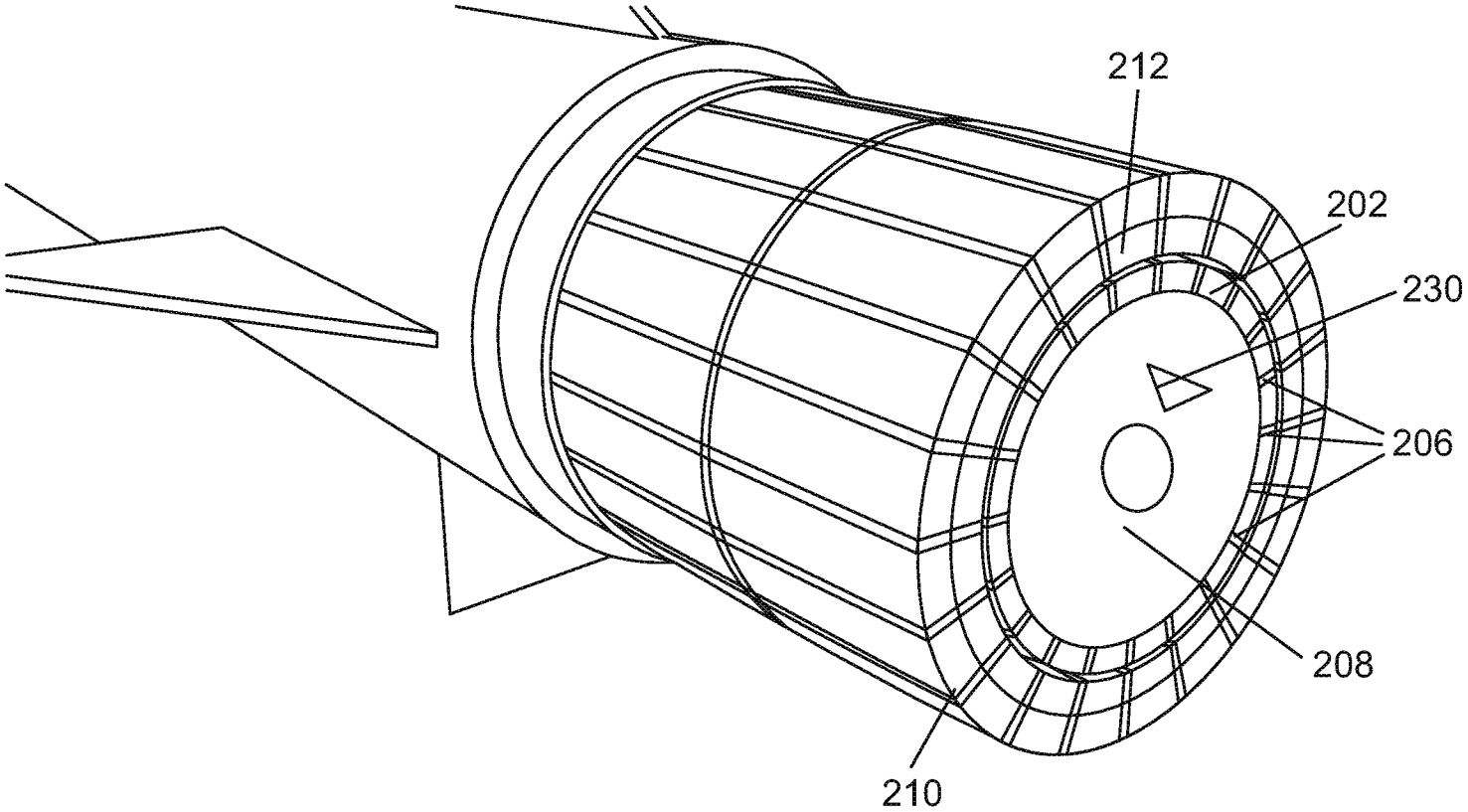
Figure 33:
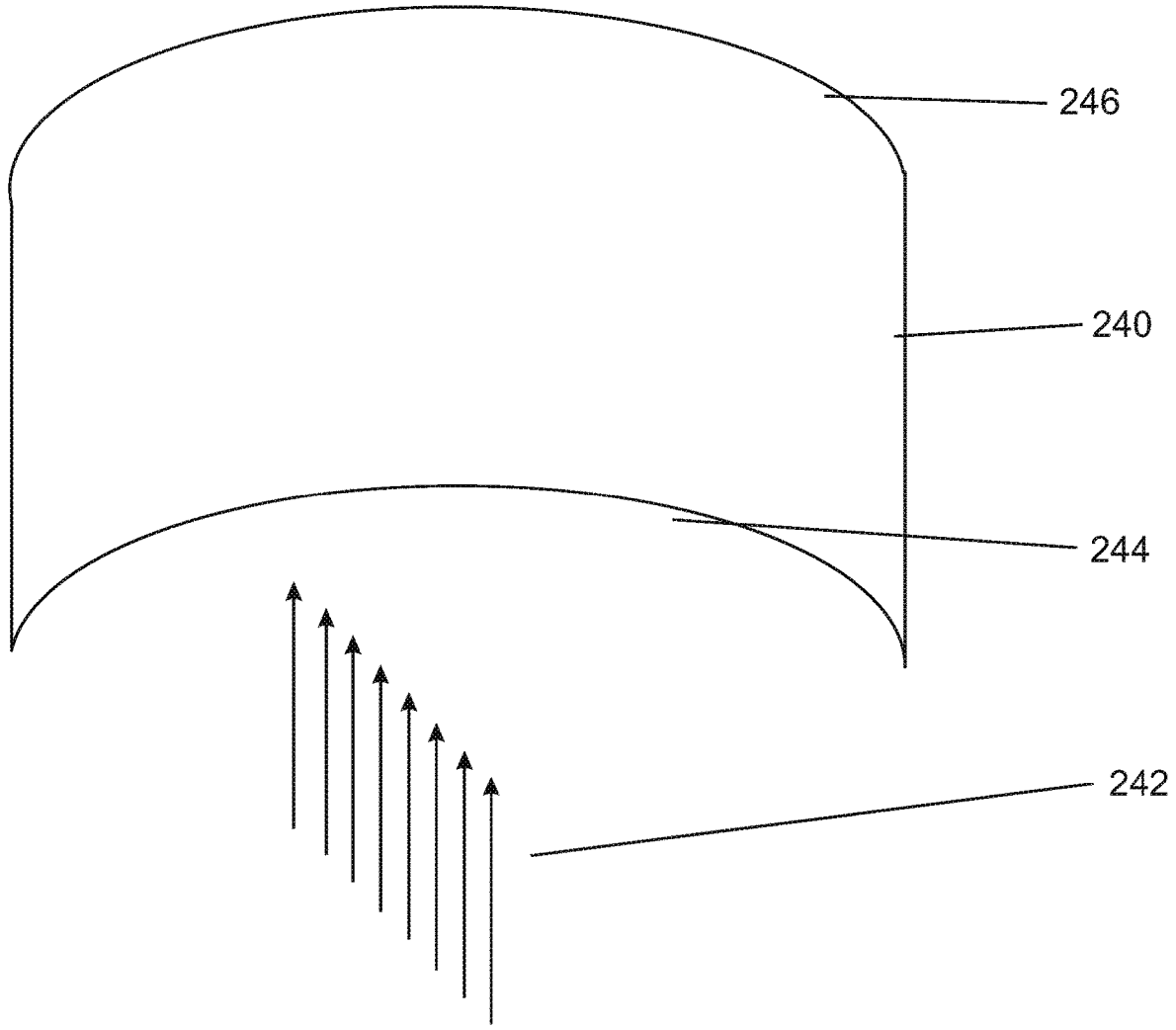

FIGS. 27, 28, 29, 30, 31 and 32 are simplified schematic diagrams showing further preferred embodiments of the present invention in which the fragmentation material lies outside the separately detonatable explosive units; and FIG. 33 is a simplified schematic diagram of a fragment according to the present embodiments which has a concave shape to capture blast energy, thus allowing the blast energy to power the fragment cloud into the target.

DESCRIPTION OF SPECIFIC EMBODIMENTS OF THE INVENTION

The present invention, in some embodiments thereof, relates to a warhead and, more particularly, but not exclusively, to a warhead capable of providing a directional fragmentation cloud according to the present embodiments.

Figure 1:
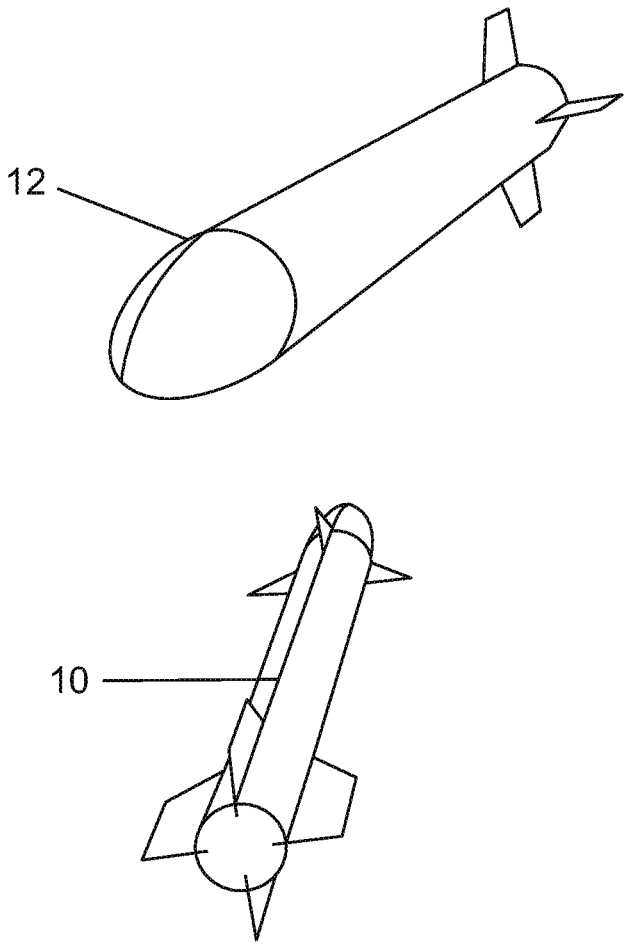
FIG. 1 Prior Art
FIGS. 1, 2, 3 are schematic diagrams illustrating interception of an incoming missile target according to methods known in the art.
Figure 2:
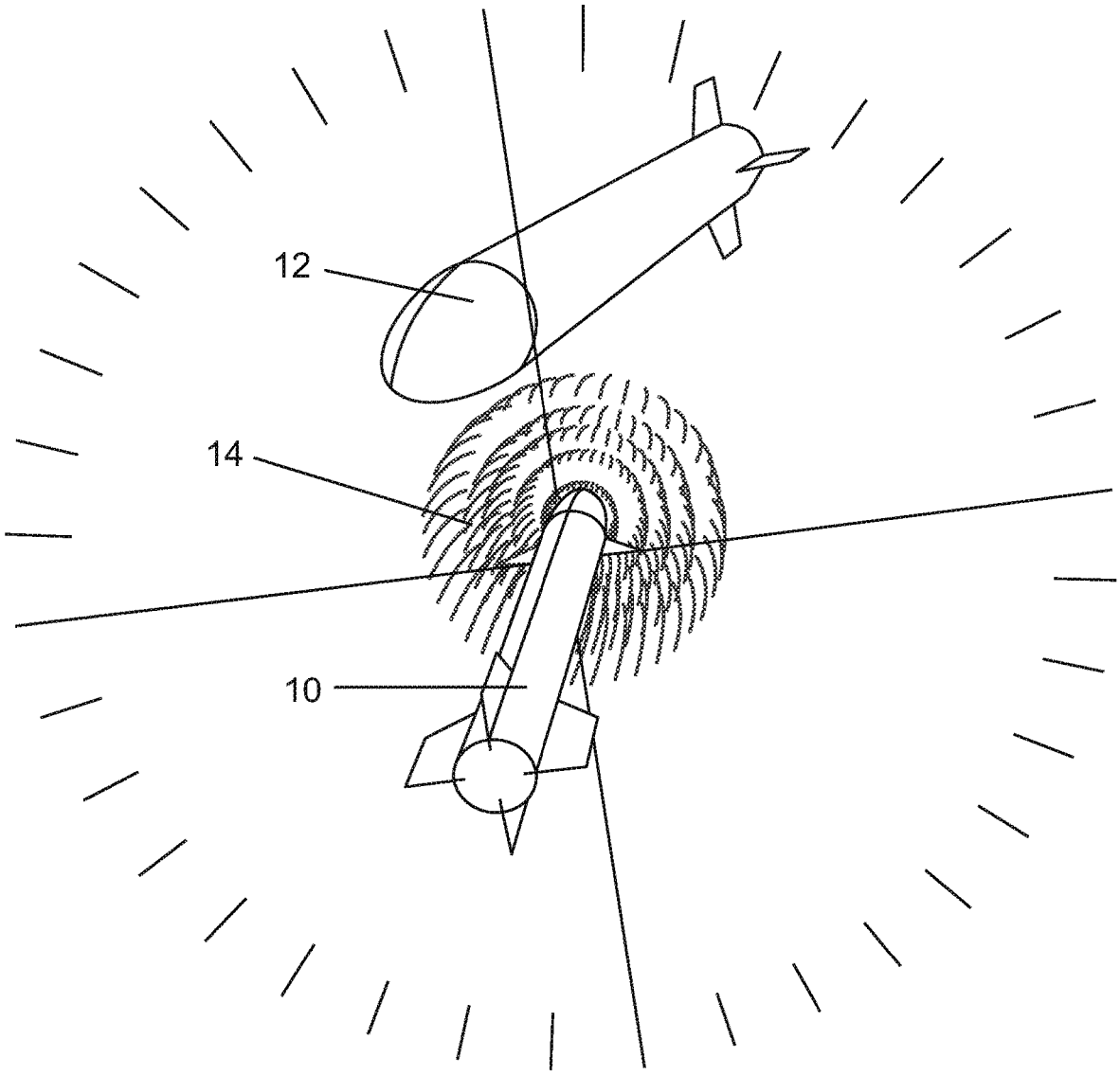
FIG. 2 Prior Art
Figure 3:
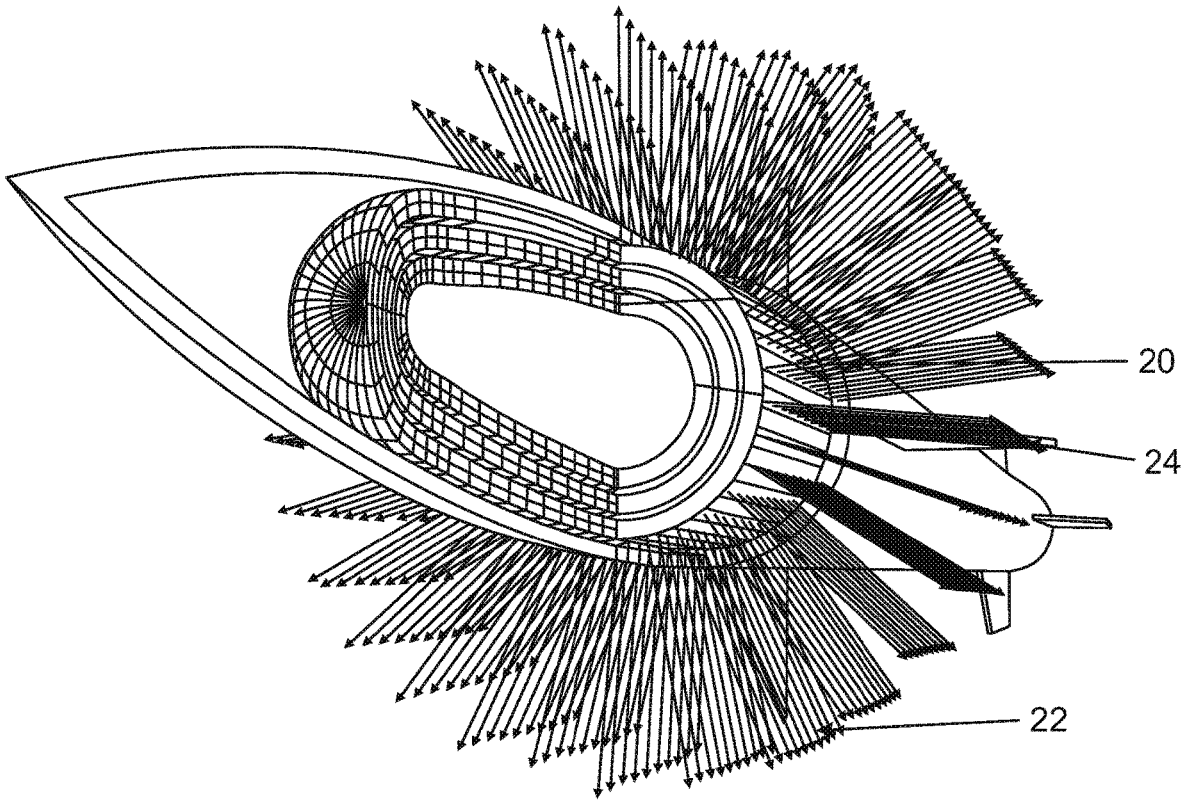
FIG. 3 Prior Art

For purposes of better understanding some embodiments of the present invention, reference is first made to the construction and operation of a conventional aerial interception warhead as illustrated in FIGS. 1 to 3, already discussed in the background. Reference is made to FIG. 1, which shows an interceptor missile 10 that is on course to intercept hostile missile 12. Generally such interceptors do not actually hit their targets but explode in the vicinity so that the blast and fragments destroy or damage the hostile missile.

As shown in FIG. 2, interceptor missile 10 explodes in proximity to its target, and the blast and fragments 14 spread out in all directions. As a result, only about 20% of the energy of the blast takes part in the interception, and the remainder of the energy is wasted.

FIG. 3 is a cutaway view of interceptor missile 10, showing the warhead 20. Layers of fragments 22 surround a central core 24 of high explosive and when in proximity to the hostile warhead, the central core explodes. The blast and fragments expand outwardly in all directions.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 4:
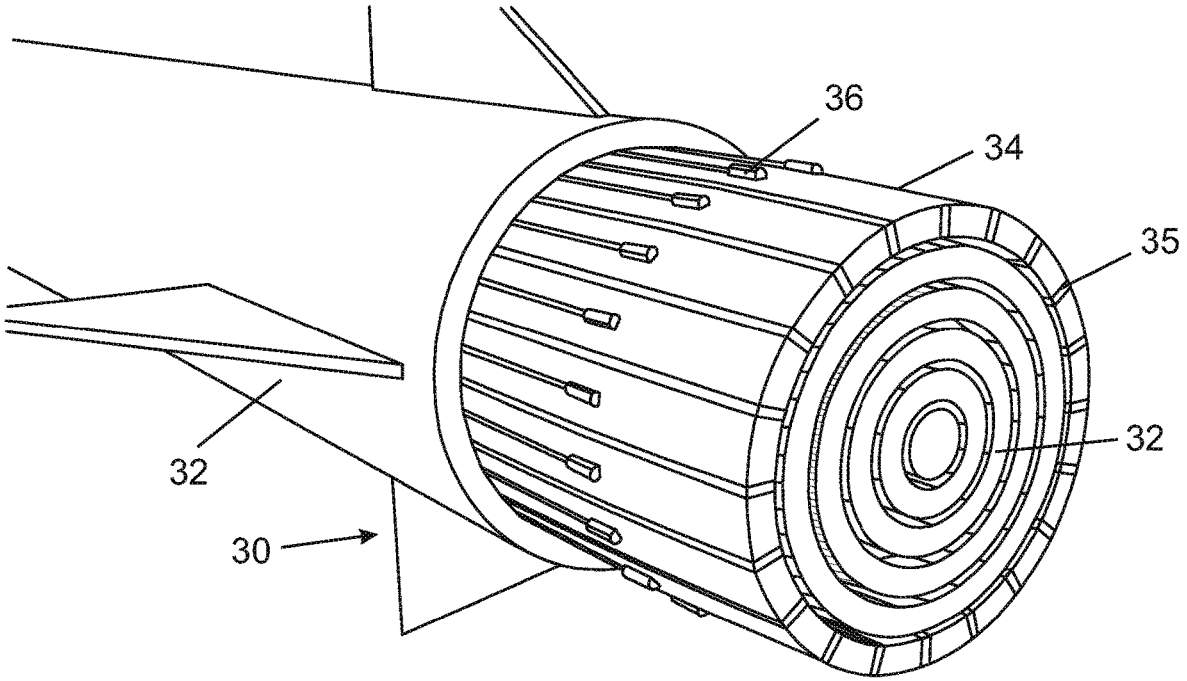
FIGS. 4 and 5 are two cutaway views of a warhead according to a first embodiment of the present invention.
Figure 5:
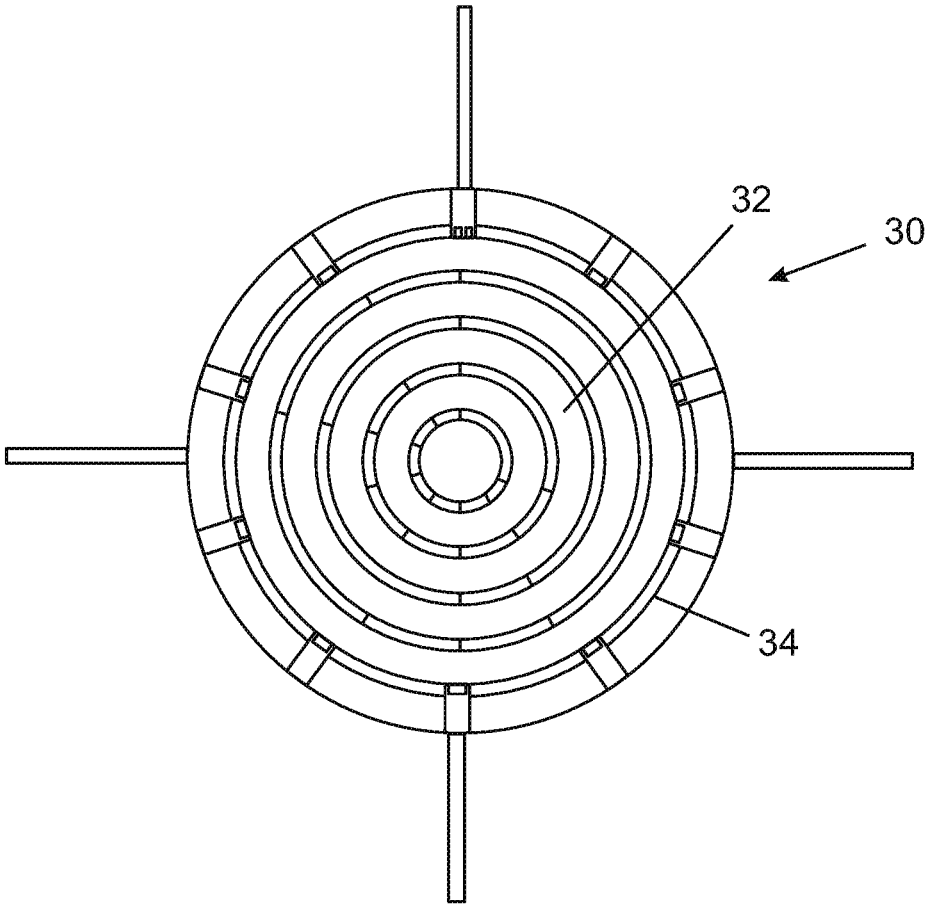

Reference is now made to FIGS. 4 and 5, which are simplified diagrams showing a cross-section of a warhead 30 mounted on interceptor missile 32 according to an embodiment of the present invention.

As shown in FIG. 4 warhead 30 has a central core made up of fragments or fragmentable material 32. The material may be in layers. Blocks of explosive charges 34 are arranged around the periphery and each block has a separate detonator 36. The detonators may be separately controllable so that the explosive may be directed of focused in any suitable direction. The blocks of explosive charges form separately detonatable units and may be separated from the neighbouring units by energy absorbing dividers or walls 35, for example made of metal or polymers or ceramics, including ballistic ceramics. In an embodiment the dividers may surround the explosive units on two or even three sides. In one embodiment, the dividers may surround the explosive units on all four sides, but may be thinner at a desired location to direct the explosion. Thus if the hostile target is below, the charges above may be detonated so that the explosion is directed below. In embodiments, not all of the charges are detonated on the opposite side but only certain of the charges are selected, so as to focus the explosion into a beam and thus magnify the power.

The decision as to which charges to detonate may be made locally on the missile or may be made remotely. The decision may for example be based on sensors located on the interceptor missile, where a weighting to one side of the sensor signals may be used to control the detonation. The sensors may be R.F sensors including optical and infrared sensors or magnetic sensors. Alternatively, remote tracking of the target and the interceptor may be used to make the decision. As a result, a smaller warhead may be used for the same result, or a same size warhead may be used to greater effect.

Figure 6:
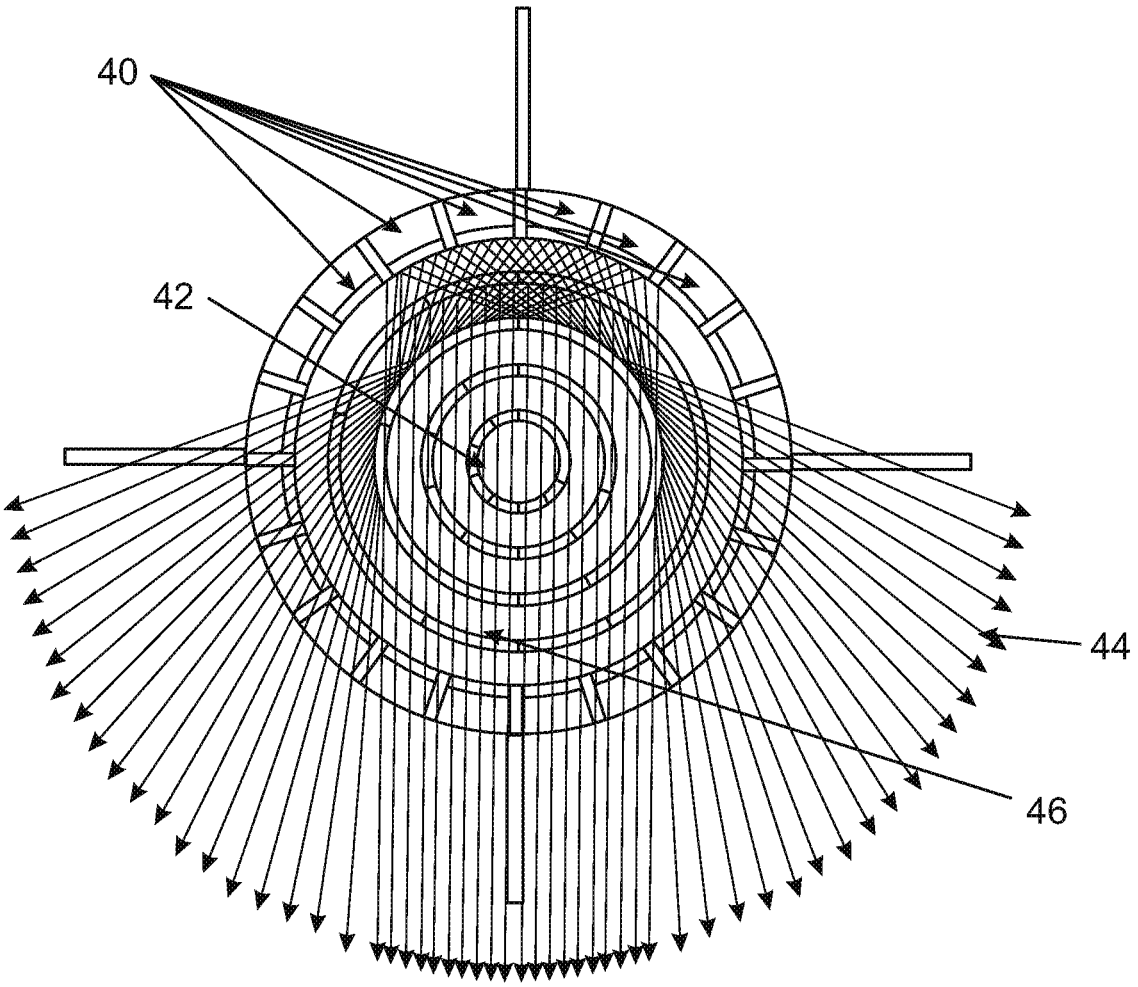
FIGS. 6, 7 and 8 are three views of fragmentation clouds caused by detonations of the warhead of FIGS. 4 and 5.
Figure 7:
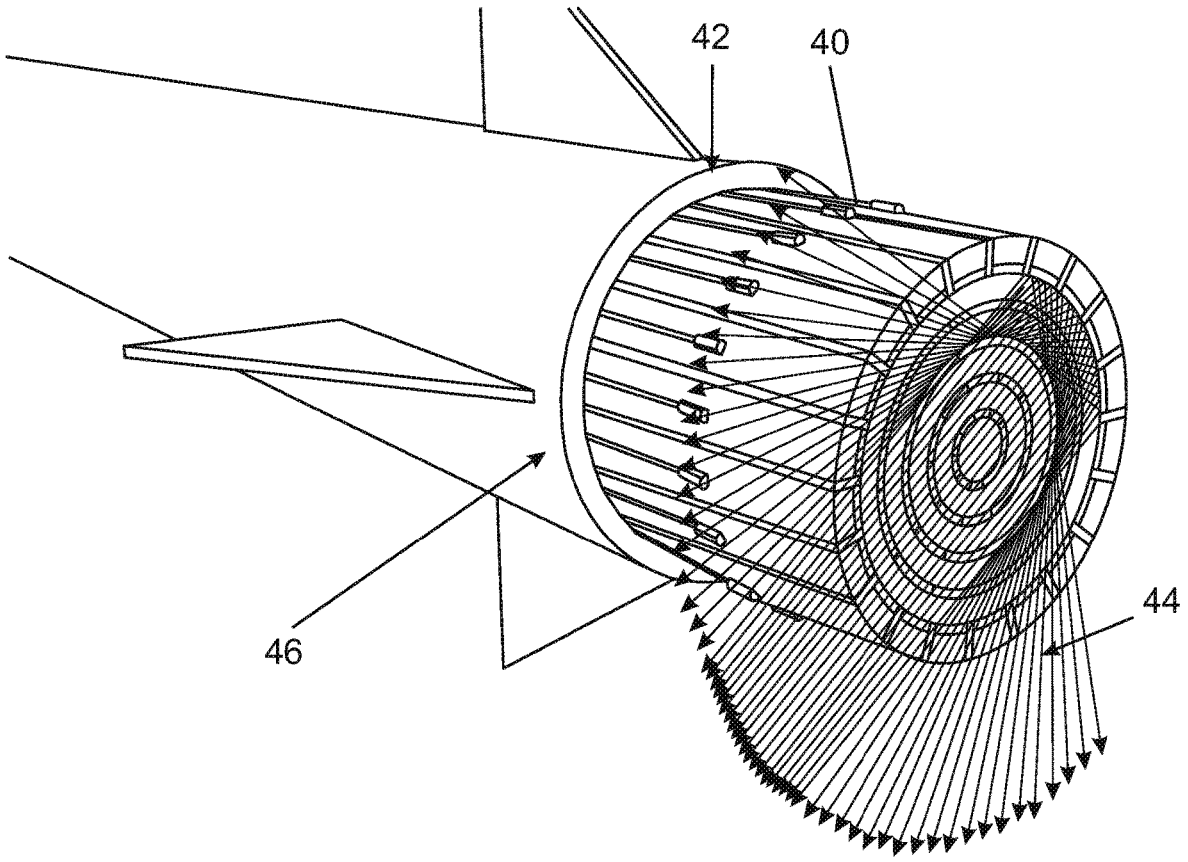
Figure 8:
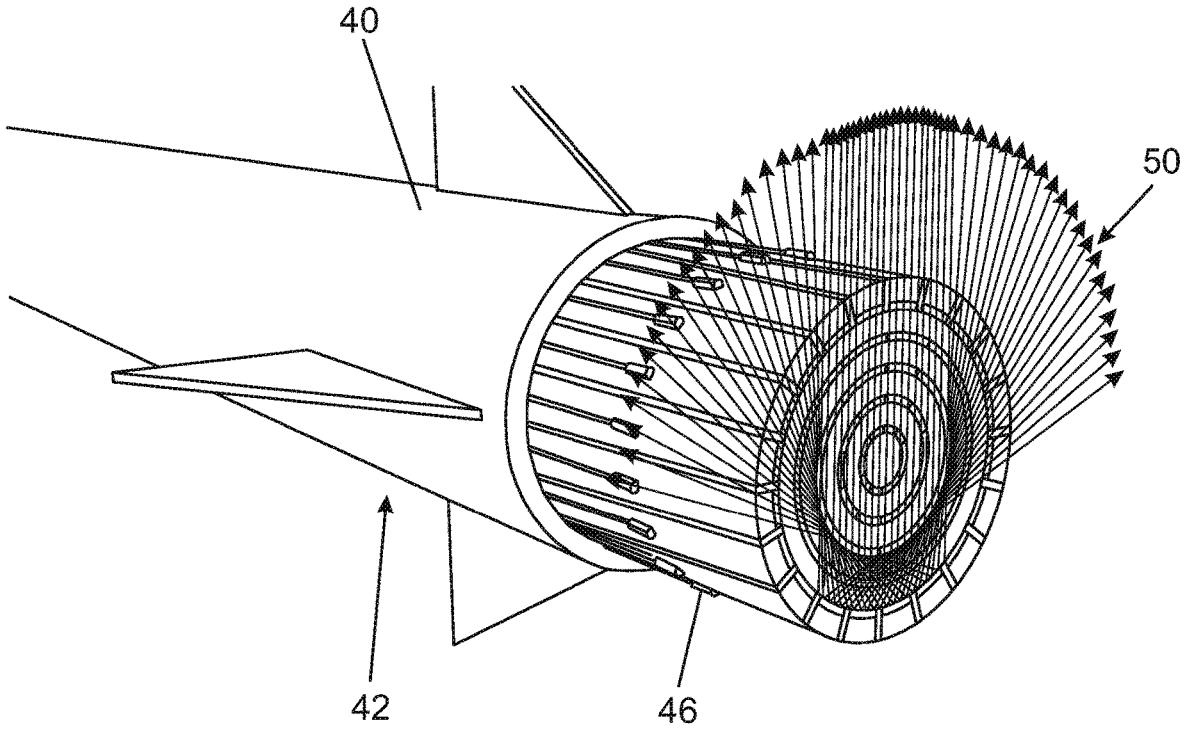

Reference is now made to FIGS. 6 and 7, which are two simplified diagrams illustrating a situation in which the units at the top side 40 of the warhead 42 are detonated, causing a cloud of fragmentation particles 44 to explode outwardly on the opposite, lower side 46 of the warhead 42. FIG. 8 shows the situation in which the units at the lower side 46 of the warhead 42 are detonated to cause a cloud 50 of fragmentation particles to explode out of the upper side 40 of the warhead.

Figure 9:
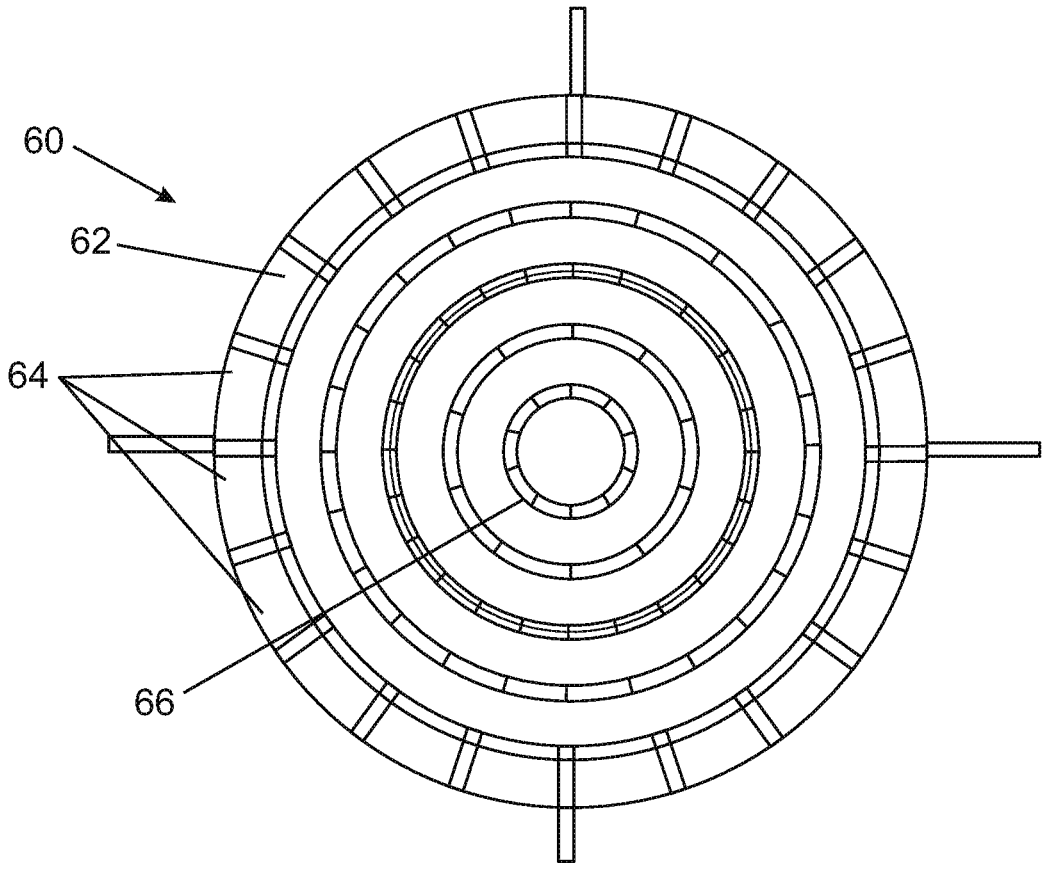
FIGS. 9 and 10 are schematic cross-sectional views of a variation of the embodiment of FIGS. 4 and 5 in which an outer surface of the separate explosive units are concave.
Figure 10:
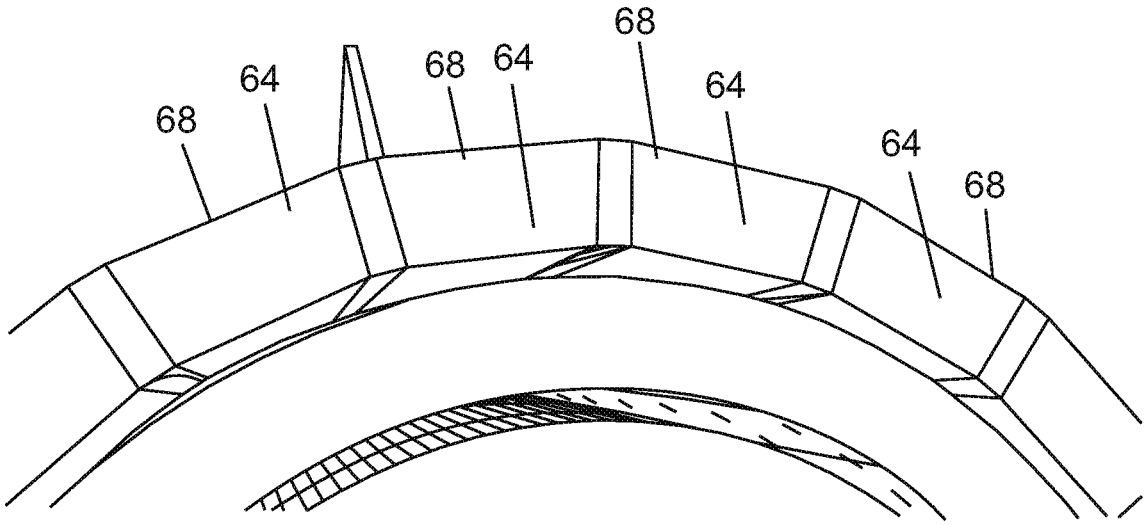

Reference is now made to FIG. 9, which is a simplified diagram illustrating a cross section of a warhead 60 according to the present embodiments. The warhead 60 comprises an outer shell 62 of separately detonatable explosive units 64. Inside the outer shell are concentric layers 66 of fragmentation material. The units 64 of the outer shell are shown in greater detail in FIG. 10 and it may be seen that the outer wall 68 of each explosive unit 64 in the present example is slightly concave.

Figure 11:
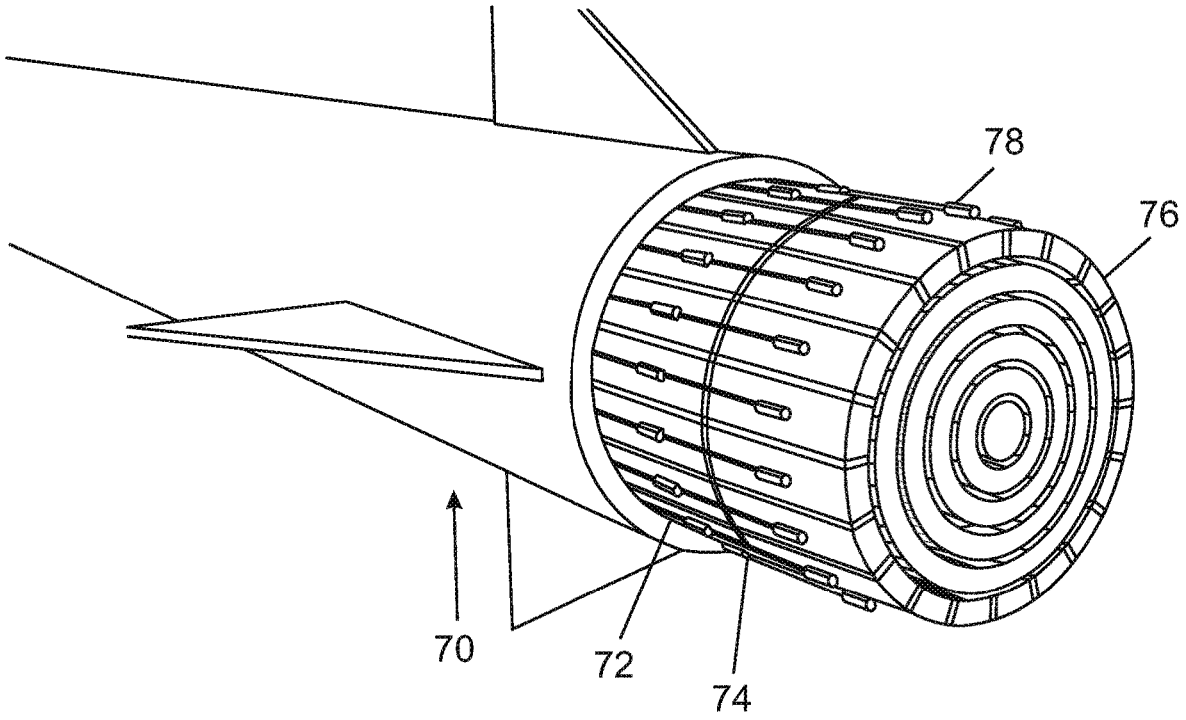
FIG. 11 is a simplified cutaway view of an embodiment of the warhead of FIGS. 4 and 5 in which there are two successive rings of separately detonatable units.

Reference is now made to FIG. 11, which is a simplified diagram illustrating a further embodiment of the present invention in which a warhead 70 comprises two successive rings 72 and 74 of explosive units, the rings being along a continuous axis.

It is noted that the ring shape is not limiting and any other suitable shape of outer shell may be considered. Each ring is made up of separate explosive units 76 of which each 30 is independently detonated by dedicated detonators 78. The two rings are exploded independently, one after the other and can be exploded in different directions, say to follow the approach of a target. The two-ring embodiment is applicable to any and all of the embodiments mentioned elsewhere herein, and the embodiment is not limited to two rings. Any number of rings may be provided, and in particular a multiple ring embodiment is suited for use against a cloud of autonomous flying vehicles, in which successive rings may be detonated as the warhead progresses through the cloud.

Figure 12:
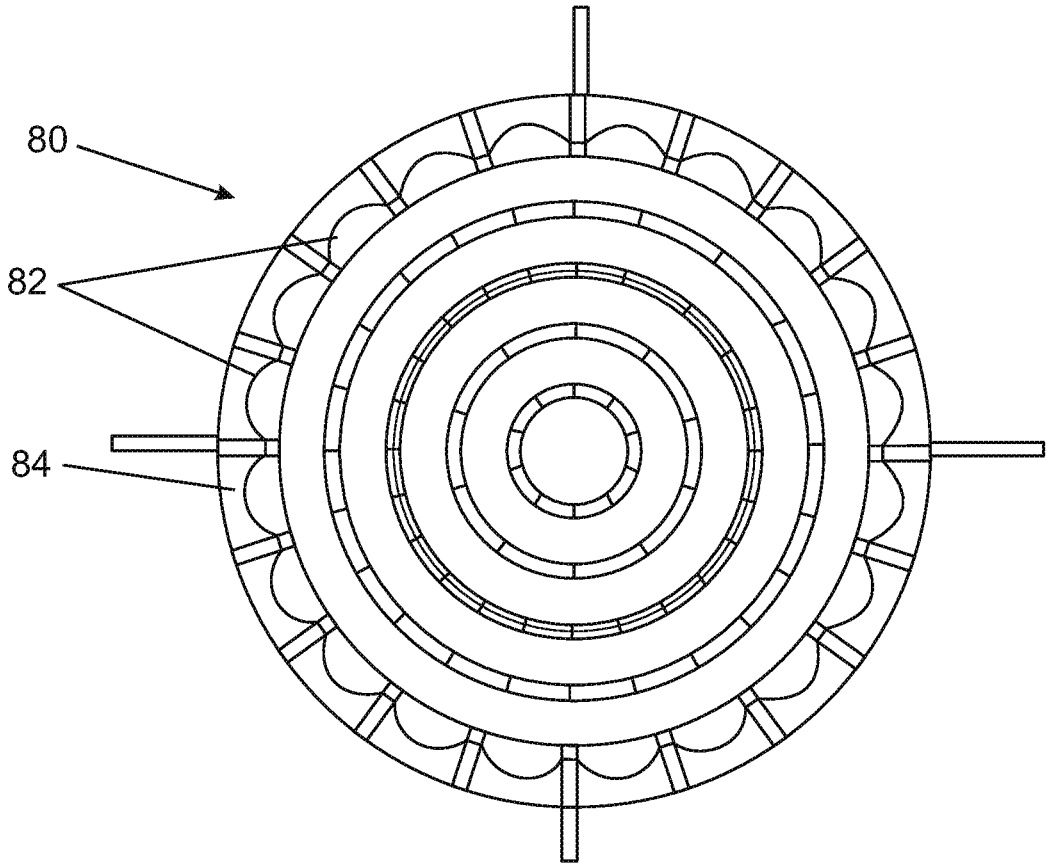
FIG. 12 is a simplified cross-sectional view of a variation of the embodiment of FIGS. 4 and 5 in which the separate explosive units have a concave inner surface towards the fragmentation core.

Reference is now made to FIG. 12, which is a simplified diagram showing a further embodiment of the present invention. As shown in FIG. 12, in warhead 80, inner surfaces 82 of separate explosive units 84 are concave. The concave shape may cause focusing of the explosion to further shape the resulting fragmentation cloud. Concave shaping may be applied to any or all of the embodiments described elsewhere herein.

Figure 13:
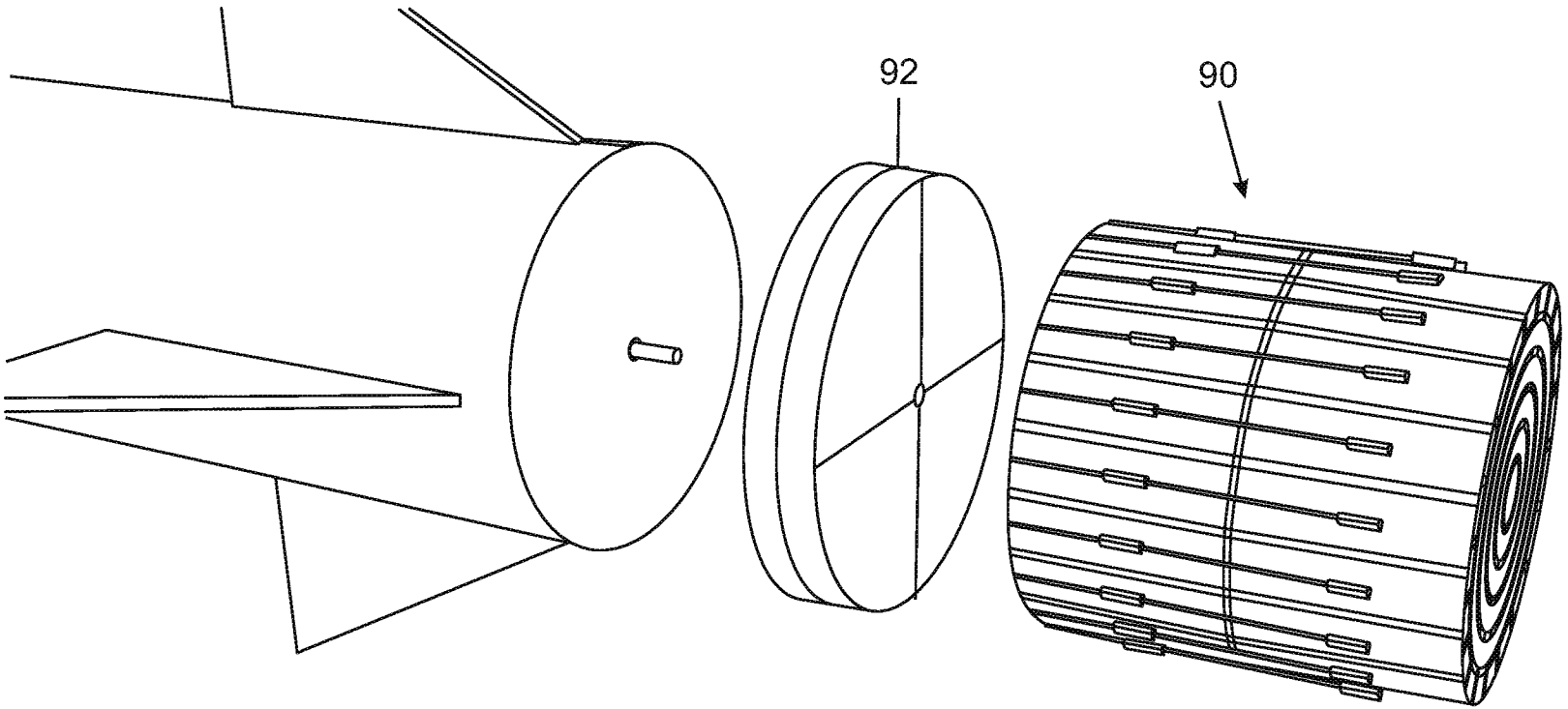
FIG. 13 is a simplified exploded view of a variation of the embodiments of FIGS. 4 and 5 in which the warhead has an explosive backplate.

Reference is now made to FIG. 13, which is an exploded diagram that shows a warhead 90 according to embodiments of the present invention. In warhead 90, here shown by way of example with two rings, an explosive endplate 92 is provided. The explosive endplate is detonated when the target is in front of the warhead in order to provide a fragmentation cloud in the forward direction.

Figure 14A:
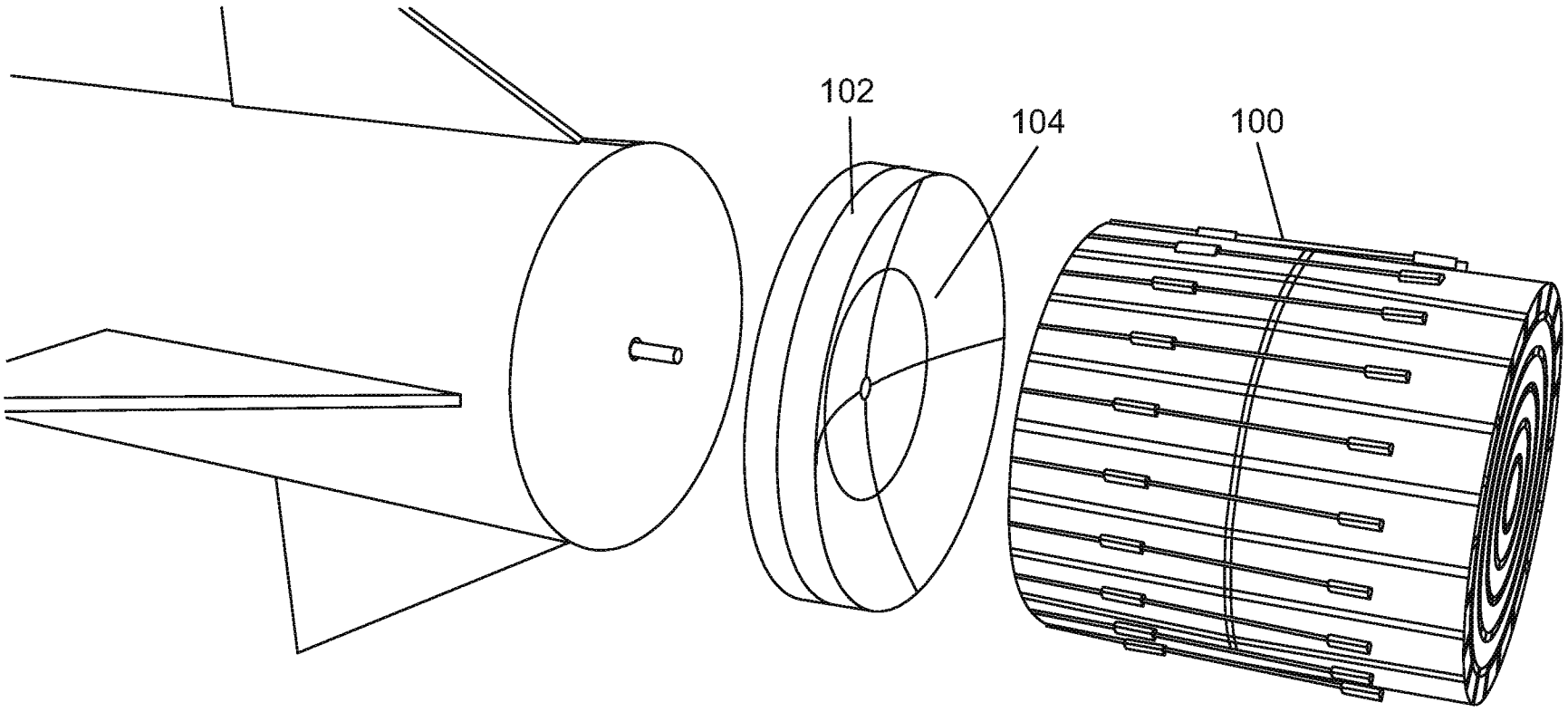
FIG. 14A is a simplified exploded view of a variation of the embodiment of FIG. 13 in which the backplate has a concave surface towards the fragmentation core.

Reference is now made to FIG. 14A, which is an exploded diagram showing a warhead 100 according to embodiments of the present invention. In warhead 100, here again shown by way of example with two rings, an explosive endplate 102 is provided.

Explosive endplate 102 has a forward surface 104 which is concave in order to focus the explosion. The explosive endplate is detonated when the target is in front of the 20 warhead in order to provide a shaped fragmentation cloud in the forward direction.

Figure 14B:
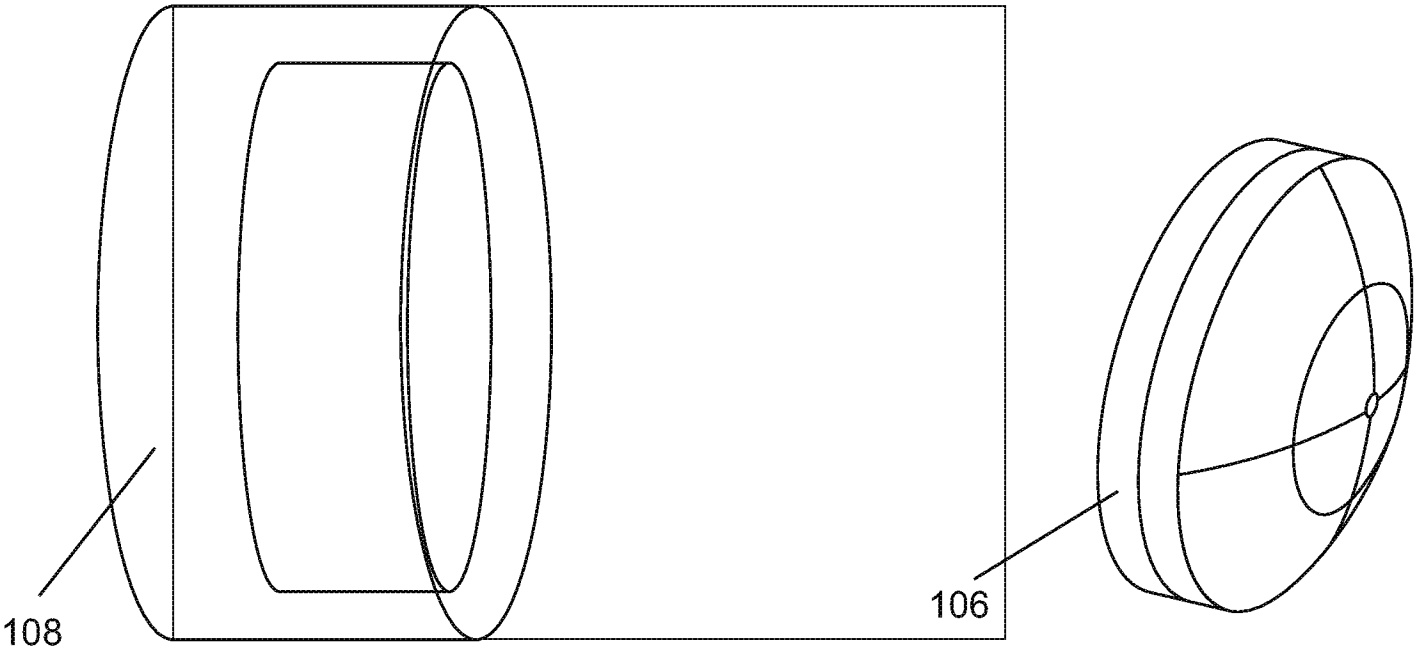
FIG. 14B is a simplified diagram showing a variation in the shape of the explosive backplate according to a further embodiment of the present invention.

FIG. 14B shows a solid view 106 and a cutaway view 108 of an alternative explosive end plate 106. The shape of the end plate is of a cylinder open at one end. The open end faces towards the explosive and the cylinder walls serve to direct the blast to provide a more focused solution.

Figure 15:
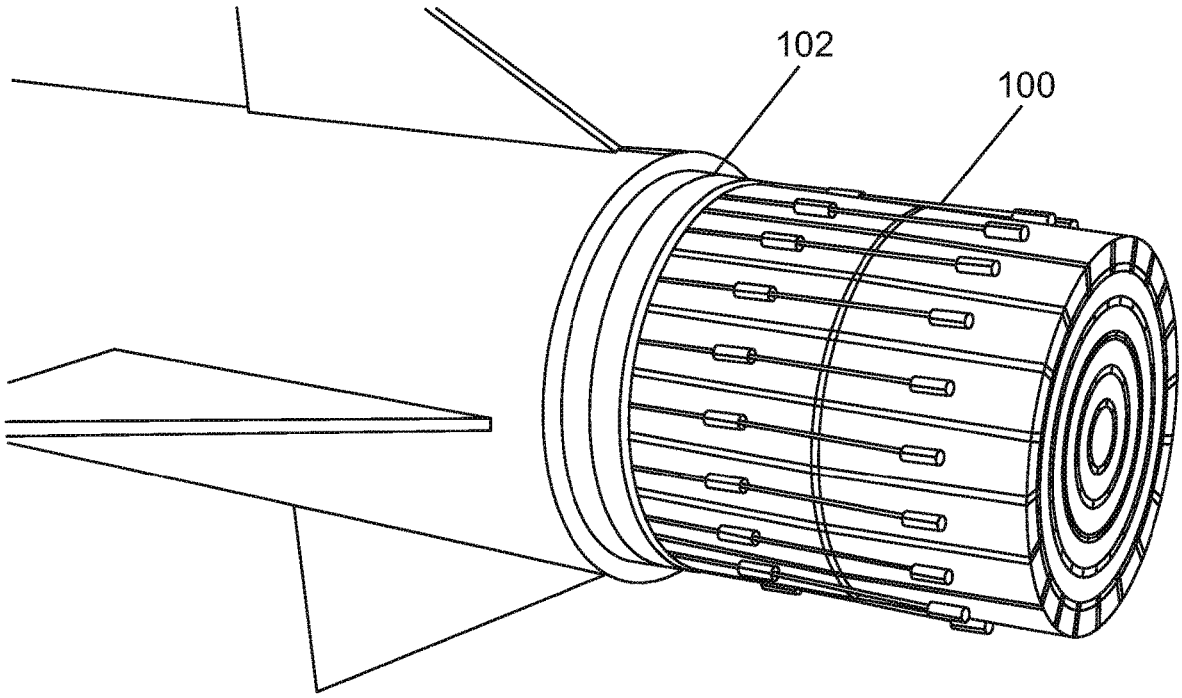
FIG. 15 is a simplified view of the embodiments of FIG. 13 or FIGS. 14A-B with the backplate fixed to the fragmentation core.

FIG. 15 illustrates the warhead of FIG. 14A with the endplate 102 in position with the rings to form the warhead 100.

Figure 16:
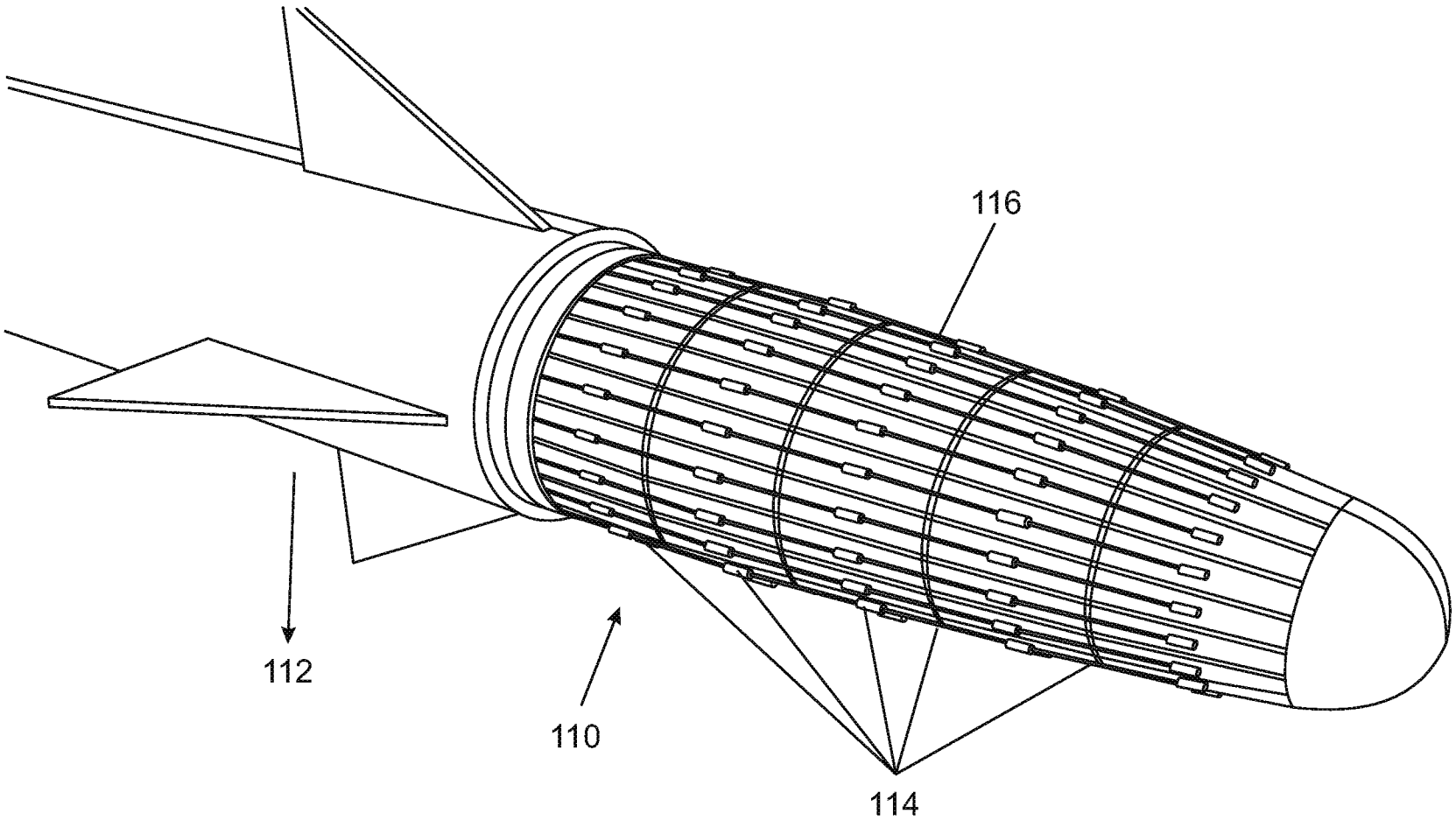
FIGS. 16 and 17 are two perspective views of a variation of the embodiment of FIGS. 4 and 5 having five successive rings of separately detonatable units.
Figure 17:
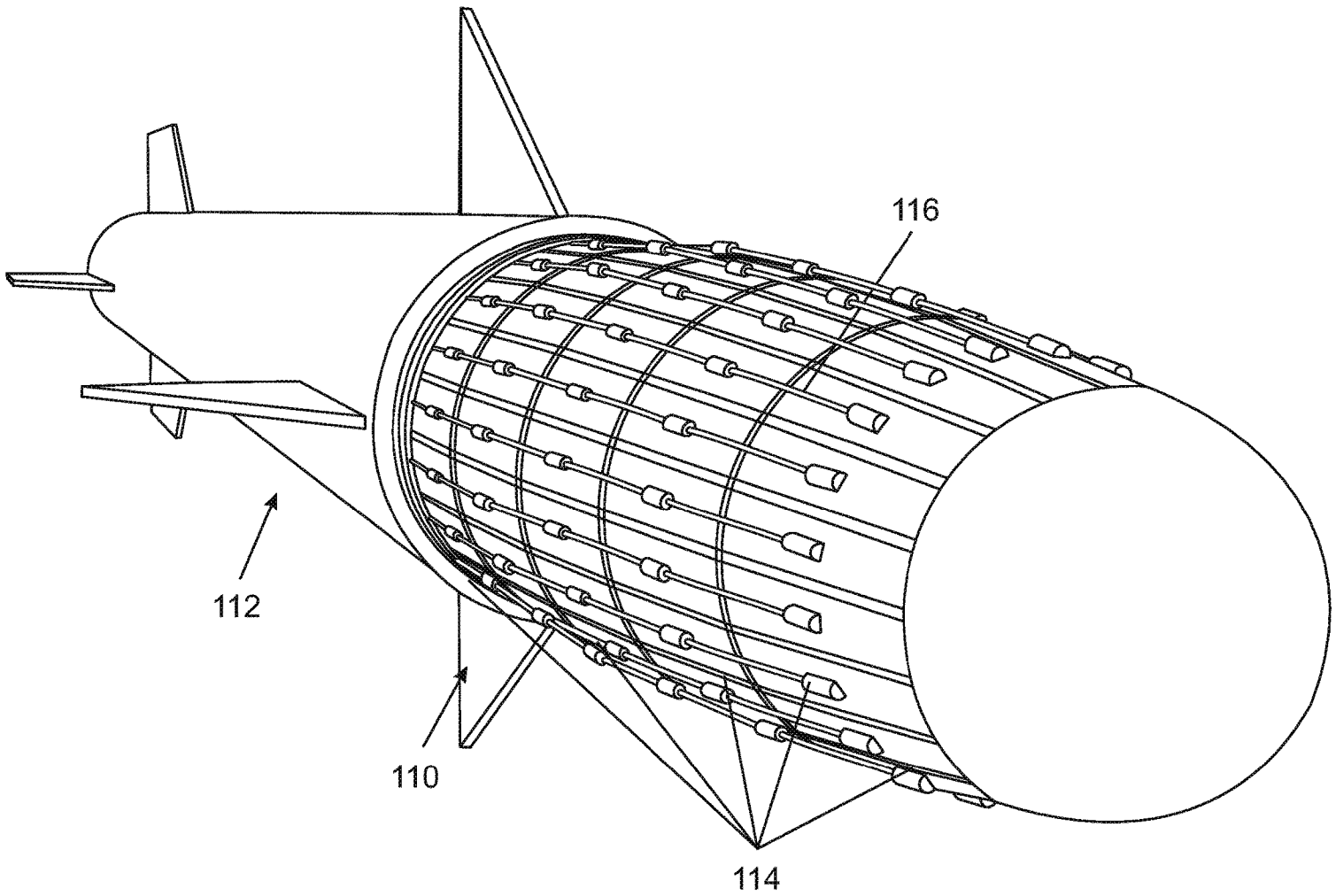

Reference is now made to FIGS. 16 and 17 which are side and front perspective views of an embodiment of a warhead 110 mounted on a rocket 112 in which five rings 114 of separately detonatable explosives are provided as separately operable segments. Each unit on each ring has a separate detonator 116 and may be activated independently so that each segment may send a fragmentation cloud at an independent time and in an independent direction. In general the rings would be detonated in close succession one after the other. The target may attempt to maneuver to avoid the warhead and thus different segments may use different detonators or combinations of detonators to direct their blasts and fragment clouds at the target as it maneuvers. The segments may separate prior to detonation, using a pyrotechnic element attached to each segment, and may be directed in a particular direction. The explosion may take advantage of existing momentum of the segment. The detonation direction may be predetermined by remote radar or may use sensors present on the warhead.

Figure 18:
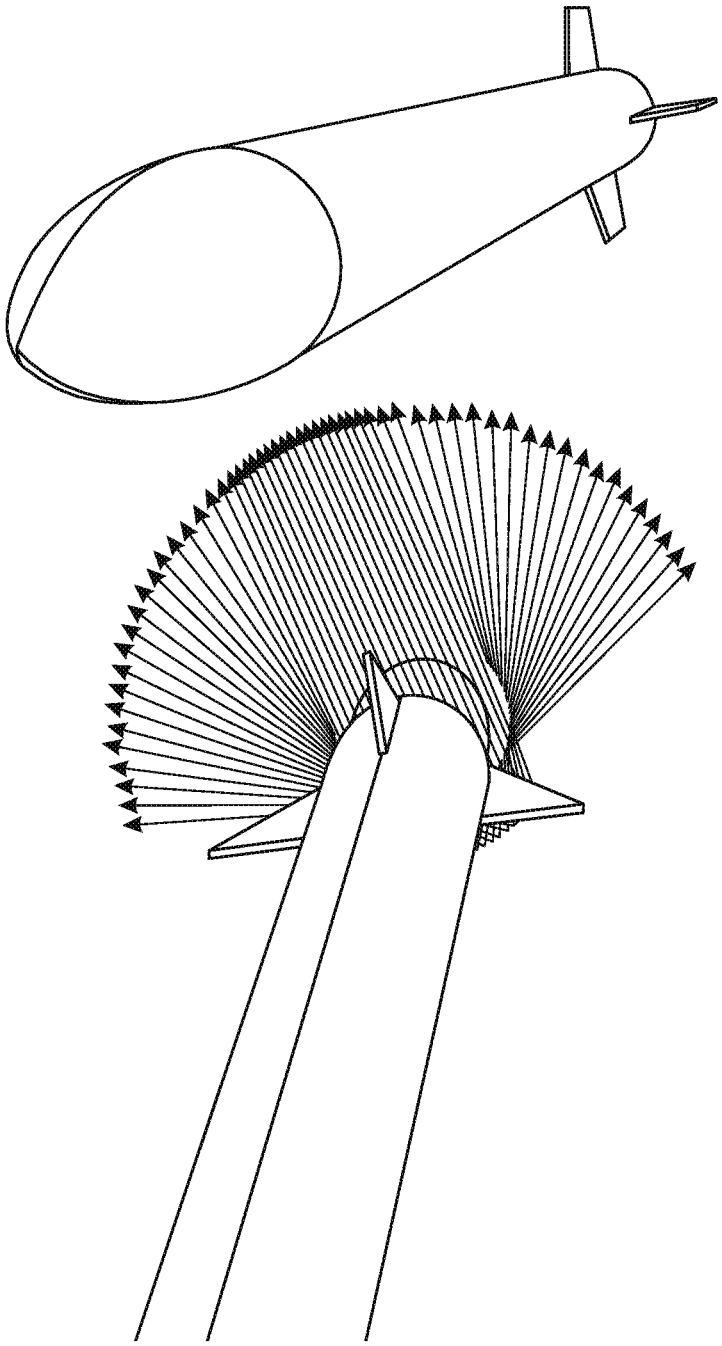
FIGS. 18, 19 and 20 are three views of interceptions being made with an interceptor missile according to the present embodiments, in which a fragmentation cloud is released in the direction of the target.
Figure 19:
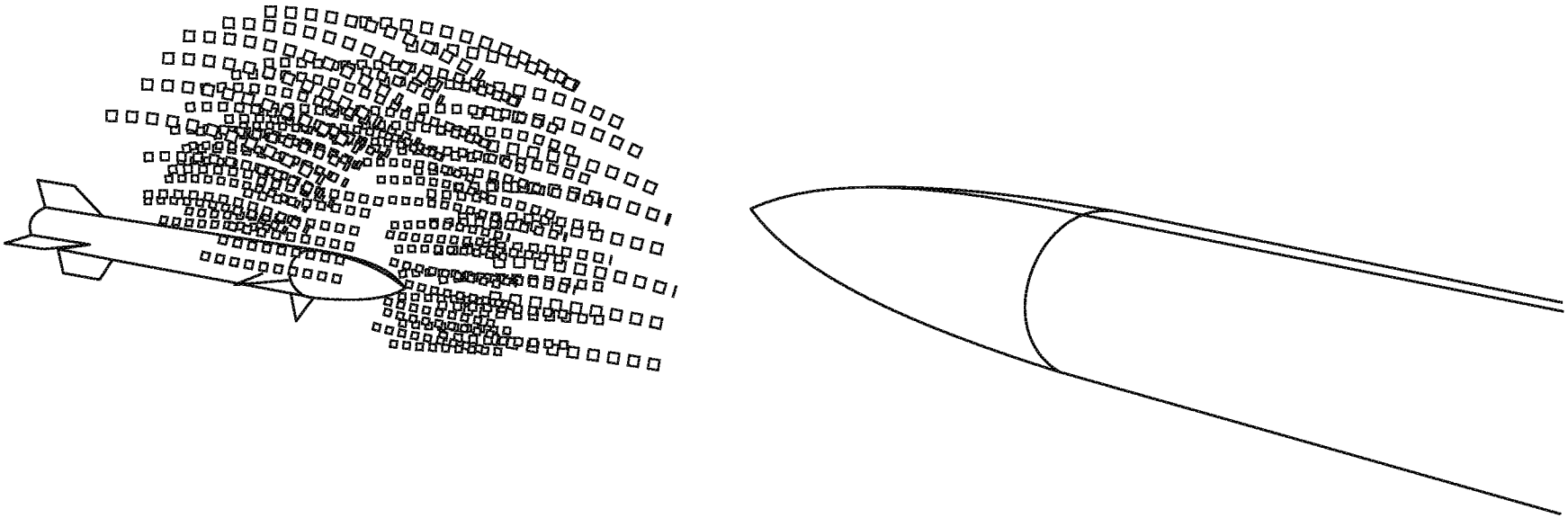
Figure 20:
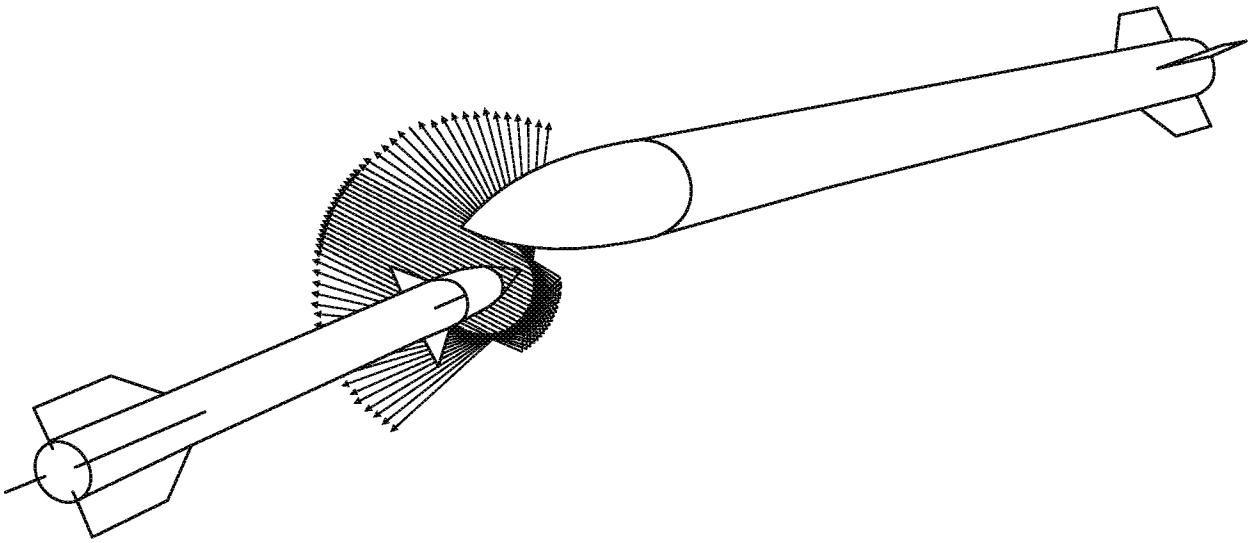

FIGS. 18-20 illustrate interceptions according to the present embodiments.

In each case the interceptor missile 120 is on one side or other of target 122, and explodes to provide a fragmentation cloud in the direction of the target. In this way the explosive energy is directed mainly towards the target and less energy is wasted, thus providing a more efficient interceptor. Consequently a given interceptor may be used on a more demanding target or a smaller interceptor may be used on the same target.

Figure 21:
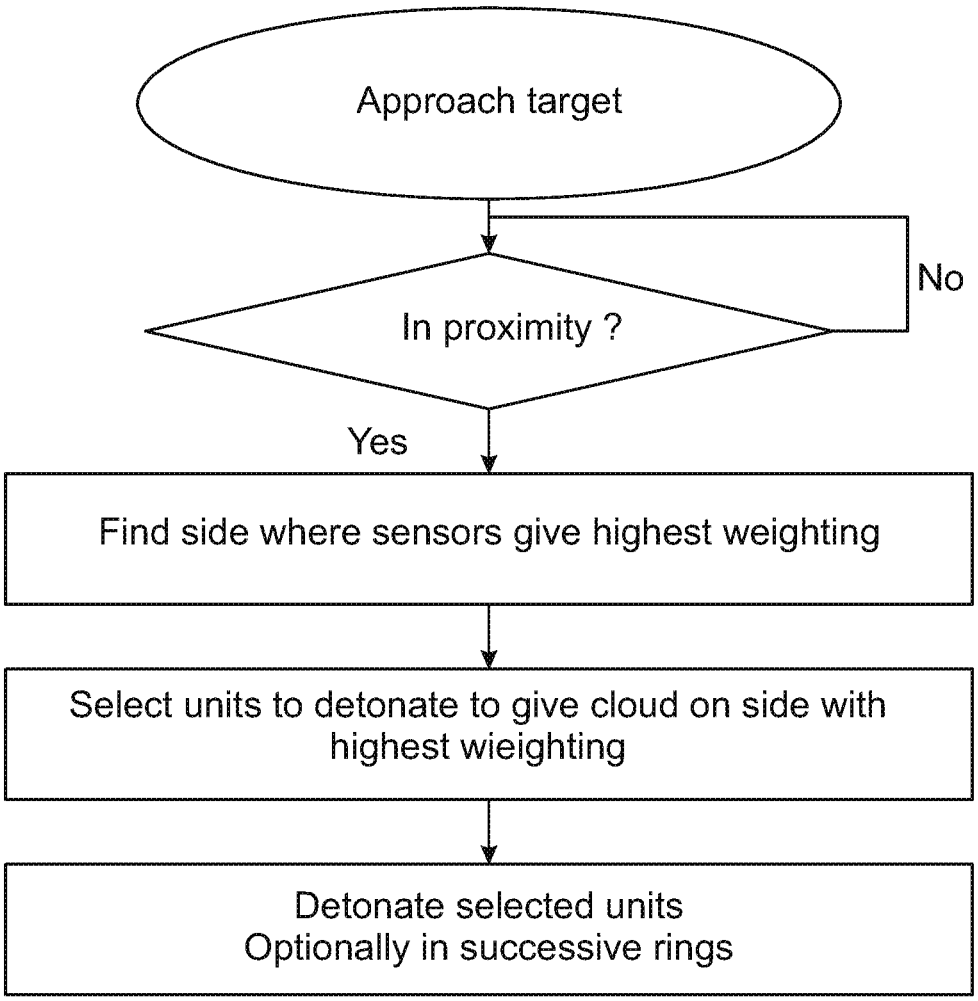
FIG. 21 is a simplified flow chart showing a method of interception of a target using embodiments of the present invention.

Reference is now made to FIG. 21, which is a simplified flow chart illustrating a method of interception of a target according to embodiments of the present invention.

As shown in FIG. 21, the interceptor may approach 130 the target. Upon detecting that the interceptor is in proximity 132 to the target the sensors may indicate a greater weighting of the target on one particular side of the interceptor or in front—134. The side with the highest weighting is then used in selecting explosive units to be detonated so as to direct the resulting fragmentation cloud towards the target—134. The selected units are then detonated to produce the desired fragmentation cloud—136.

Figure 22:
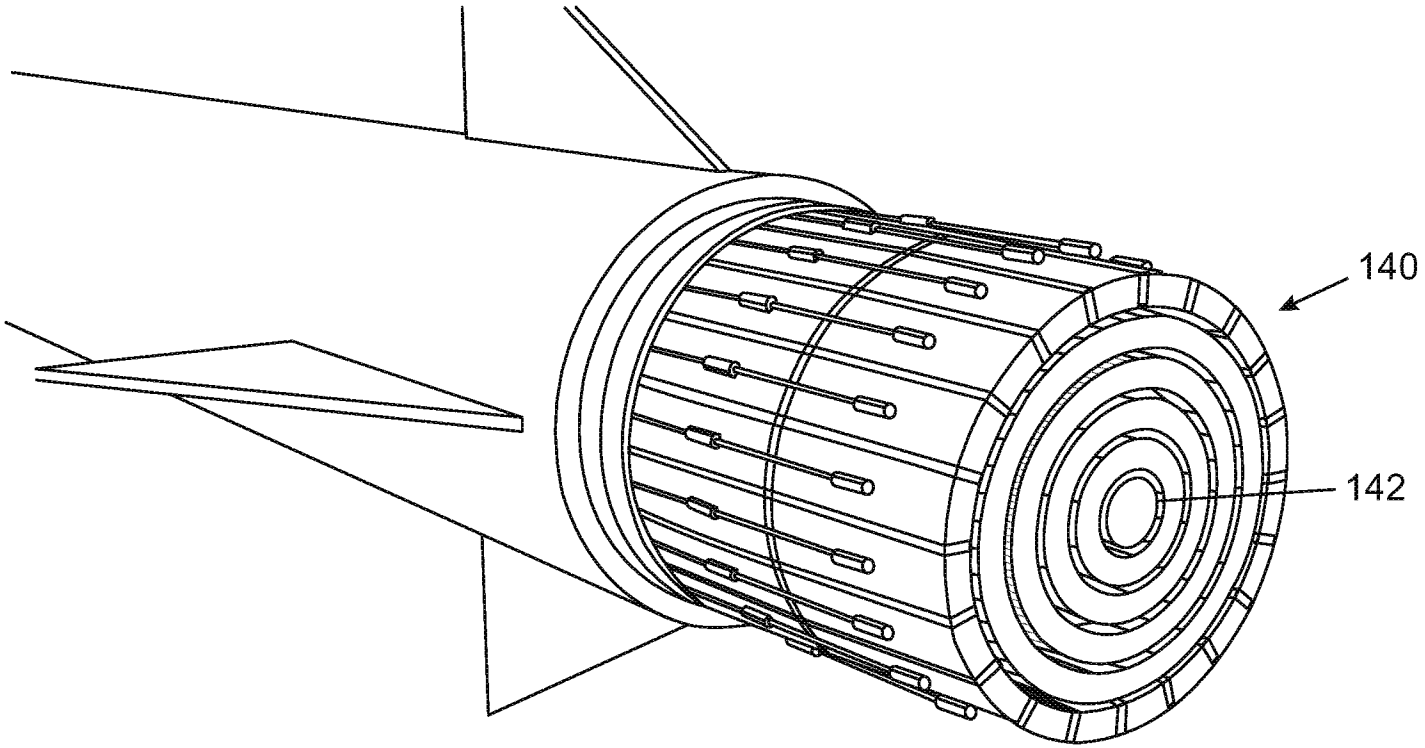
FIG. 22 is a simplified diagram of a further embodiment of the present invention having a central column of separately detonatable high explosive within the fragmentation core.

Reference is now made to FIG. 22, which is a simplified diagram illustrating a variation 140 of the embodiment of FIG. 15 in which a central column 142 of explosive is placed inside the fragmentation core of the warhead. The central column is also separately controllable to be detonated as desired and may be used together with the other explosive units to further serve in the shaping of the fragmentation cloud.

Alternatively, the central column 142 may be used alone, for example to add the possibility of an all-round explosion to the repertoire for use if needed.

The explosive units may be disposed around the fragmentation core in one or more successive rings and the rings may be detonated in succession to give a more closely focused fragmentation cloud.

Figure 23:
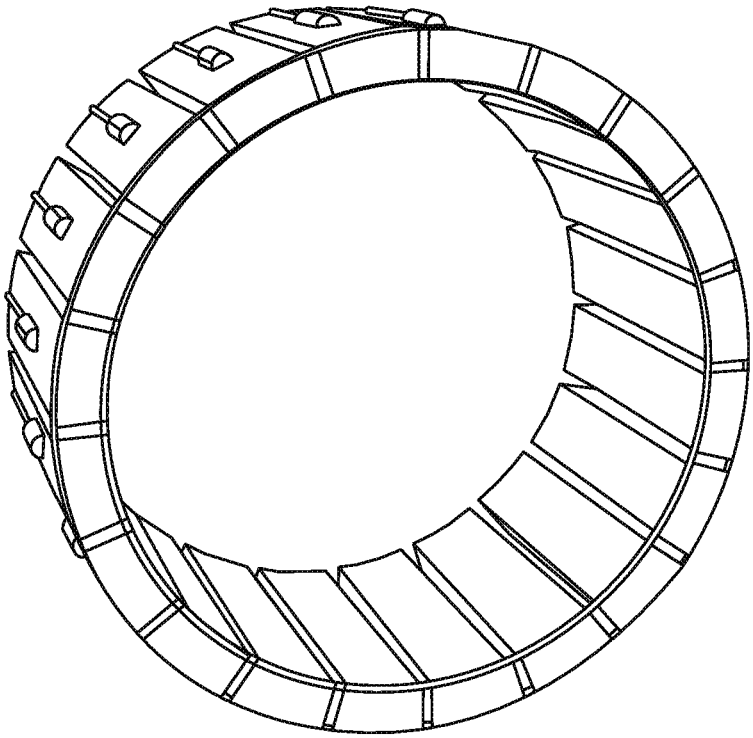

Reference is now made to FIG. 23, which is a simplified diagram showing an explosive outer shell 150 for placing around a fragmentation core or the like according to embodiments of the present invention. As shown the outer shell 150 is in the form of a ring and includes separate units 152 extending circumferentially around the ring. Each unit has a detonator 154 and different units are selected for detonation in each particular interception to produce a suitable fragmentation cloud. It is noted that the fragmentation core may not necessarily be of pure fragmentation particles but may be made up of any operational circumstances and the kind of interception involved.

Figure 24:
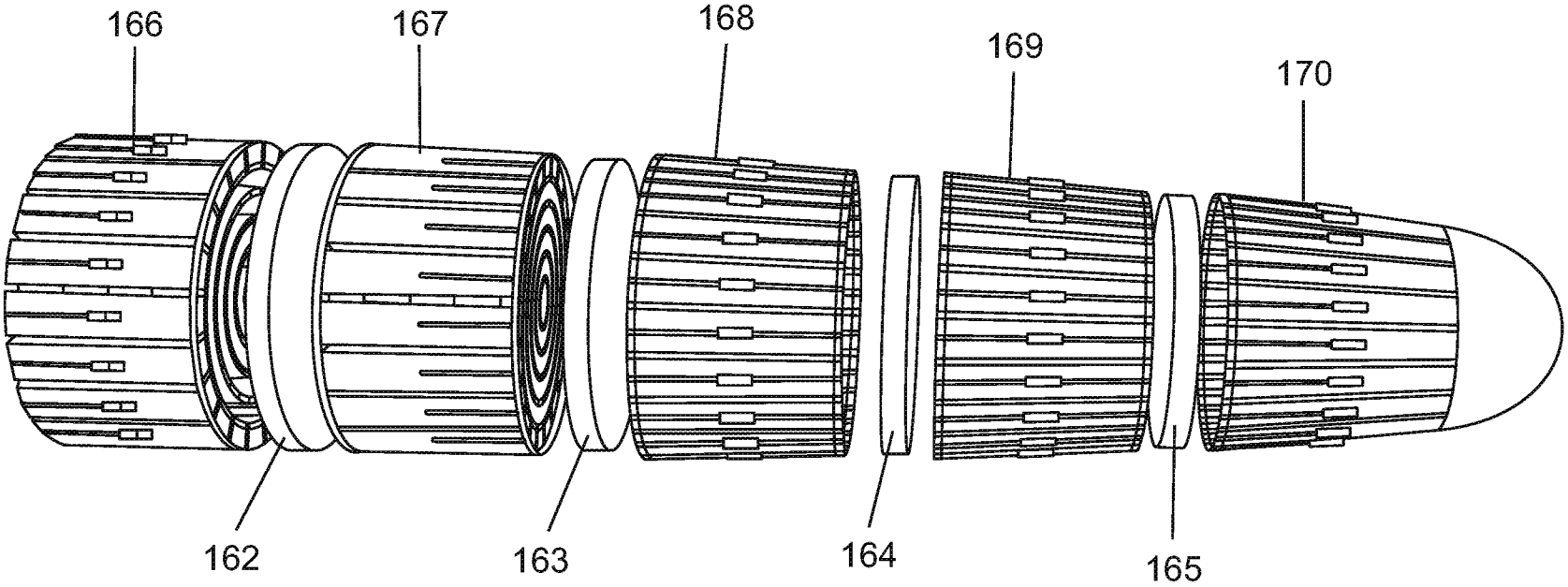
FIG. 24 is a simplified schematic exploded diagram that illustrates a five stage warhead with explosive plates between each stage.

Reference is now made to FIG. 24, which is a simplified diagram showing a five-stage warhead 160, similar to the embodiment of FIGS. 16 and 17 but with an explosive backplate 162, 163, 164, 165 between each stage 166, 167, 168, 169, 170. As with the earlier example, the stages are intended to each be detonated independently. In one embodiment, the missile body may maneuver between each launch, so that the different stages are detonated against different interception targets.

Each backplate may include a divider wall as well as explosive material. Hence the backplate may protect the succeeding stage from the explosion of the preceding stage, ensuring that the explosion is restricted to just the intended stage. Thus the backplate ensures the integrity of the succeeding stage when the preceding stage is exploded.

Figure 25:
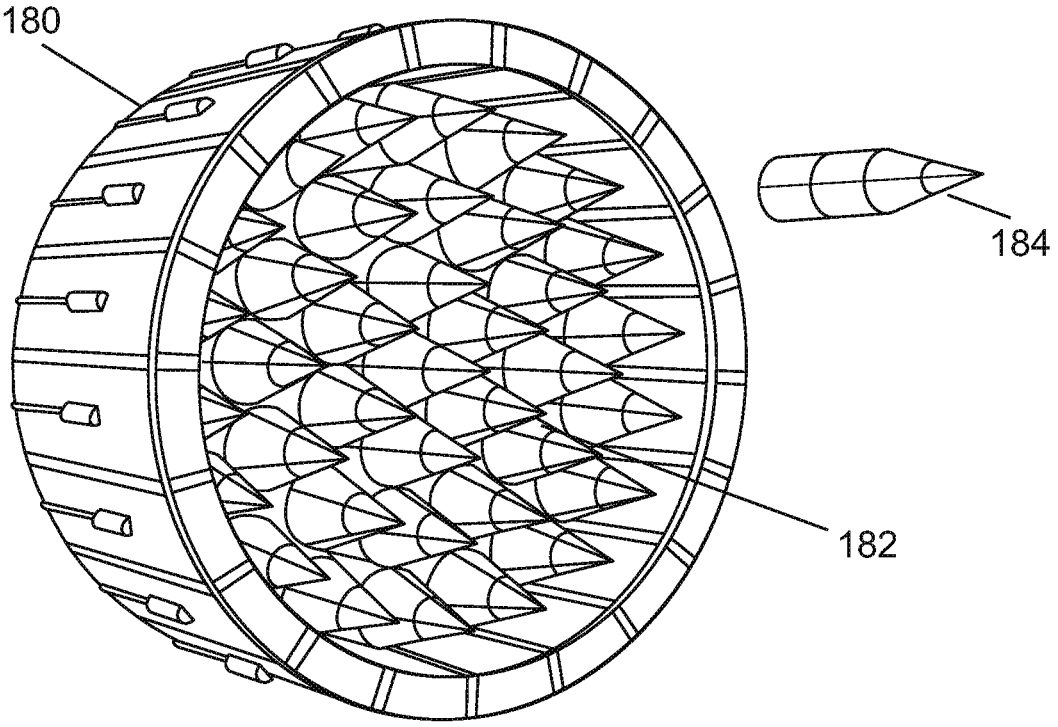
FIG. 25 is a simplified schematic diagram showing an explosive outer shell filled with a fragmentation core made of relatively large particles.

Reference is now made to FIG. 25, which is a simplified diagram showing a variation of the embodiment of FIG. 4 in which an outer explosive shell 180 surrounds a fragmentation core 182 as before. However, the fragmentation core is made up of shaped particles. In an embodiment the shaped particles may be designed for self-stabilization in flight. The particles may be homogenous or may be assorted. If homogenous, the particles may be of any shape and size but are generally the same to reasonable tolerance. In an embodiment the homogenous particles may be relatively large particles 184, for example particles that are the shape and size of bullets as illustrated, this being a shape that is self-stabilizing in flight. In some cases the particles may include fins or the like as stabilizers and a pointed nose. As well as helping with stabilization in flight, the nose may assist with penetration when hitting the target. As an alternative, the particles may be the shape and size of marbles or may be in the form of cylinders. The particle size may be selected depending on the kind of target being intercepted. In an alternative, the relatively large particles may include their own explosive to detonate in proximity with the target or after a certain duration has passed if the target is not encountered. The latter may ensure that undetonated particle bodies do not reach the ground and cause unintended casualties or damage.

In use the appropriate units in the ring are detonated, generally those on the opposite side from the target. The core is jettisoned towards the target and begins to spread out, so that the target collides with multiple ones of the particles. If the particles are explosive then the target suffers multiple small explosions.

Figure 26:
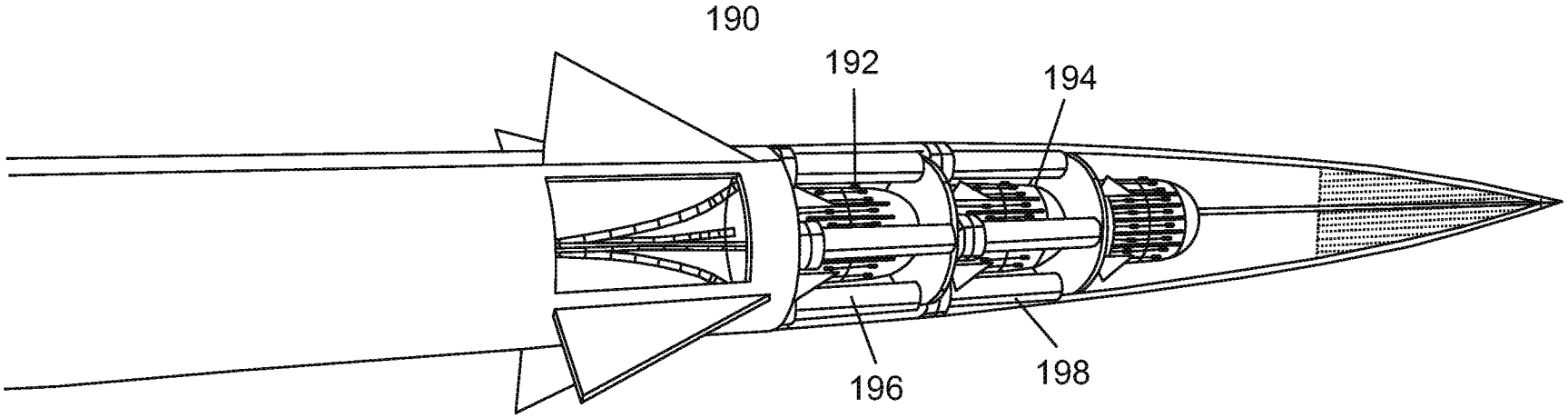
FIG. 26 is a simplified diagram showing multiple stages with a framework for releasing each stage prior to detonation.

Reference is now made to FIG. 26, which is a simplified cutaway diagram illustrating a structure 190 for accommodating multiple warhead stages according to an embodiment of the present invention. As shown in FIG. 26, each warhead stage 192, 194, is encompassed within a frame 196, 198, which is able to detach the stage from the missile. The stage, under support of the frame, continues with its own momentum while the missile behind it may maneuver. The stage then detonates as before.

The above has been described in respect of a missile for aerial interception.

However, a further embodiment may be used for anti-personnel or land use in general.

The present structure in which a fragmentation core is surrounded by an outer explosive shell, may be used to allow an artillery shell or the like to be exploded above a ground target, with the fragmentation particles all directed downwards instead of half of the energy of the explosion being directed away from the target. Known sensors are able to determine the orientation to direct the explosion, and this can be achieved even with shells that spin due to rifling.

Figure 27:
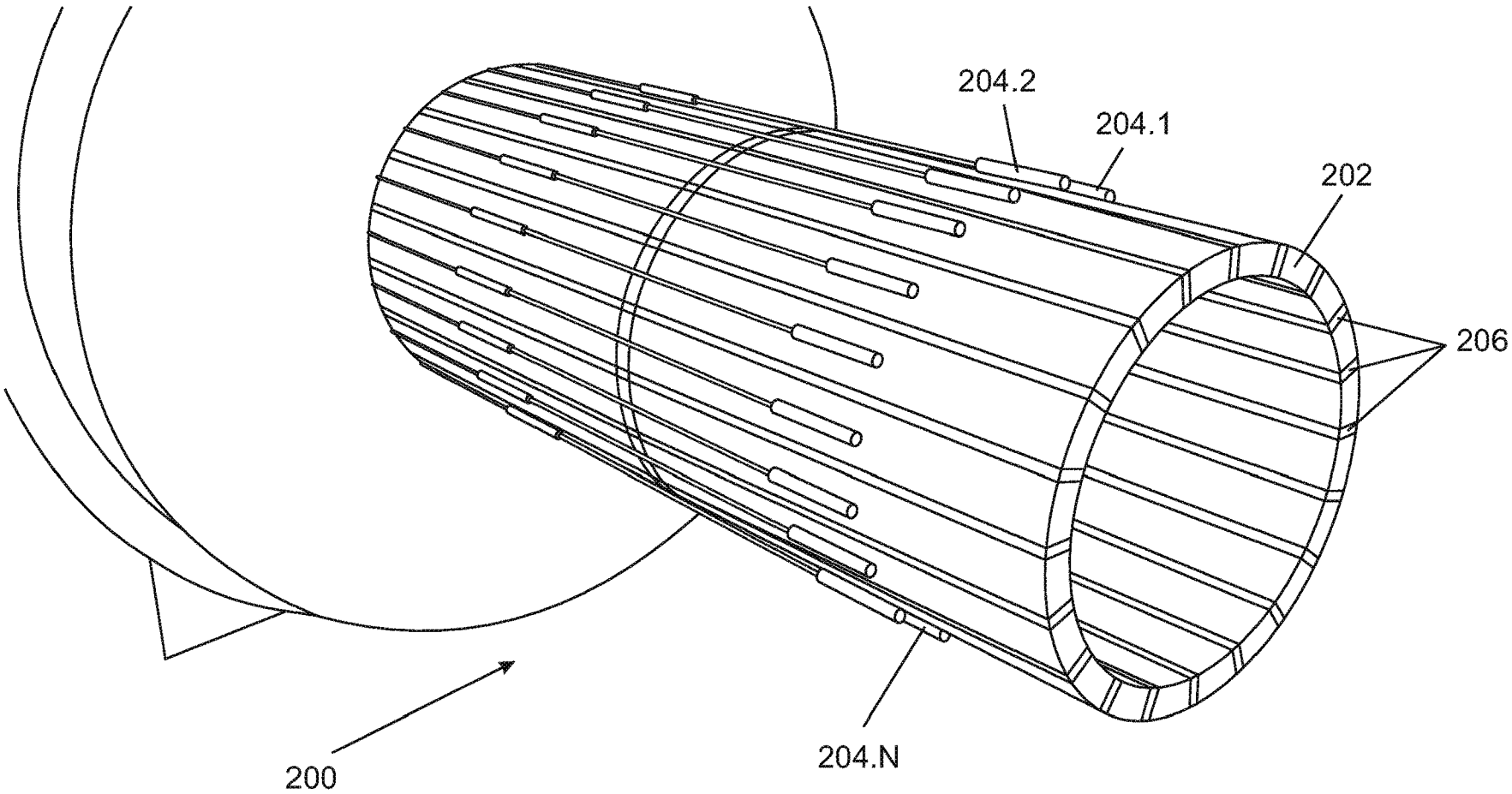

Reference is now made to FIG. 27, which is a simplified schematic sectional diagram of a missile 200 according to an alternative embodiment of the present invention. A ring 202 of separately operable detonators 204.1 . . . **204.*n* underlies an outer layer of fragmentation material not shown. Any one or a combination of the detonators may be selected to cause a directed blast and fragment cloud in a selected direction. In the embodiment of FIG. 27, the detonators are inside the fragmentation ring, but the principle of choosing the direction of the blast remains the same. As with the previous embodiments, it is possible to have second, third and more rings to give more focused direction. Spacers 206 may separate the explosives between detonators and interrupt blast waves so that each detonation can be independent and cause focusing, although it is noted that the entire structure explodes in the end. The spacers 206 are shown in FIG. 27 to be uniform but in fact may be of variable depth and thickness to help guide the developing explosions. Each detonator may thus be used as an independent detonation point for the purpose of directing the blast. The detonators need not be strictly in a ring as shown, but may be at different radial depths within the explosive. Furthermore, the detonators 204** are shown as being parallel with the axis on the circumference of the ring, but may also be arranged radially. Detonations may select combinations of radially and axially placed detonators for further refining of the blast shape.

In embodiments, two or more locations may be selected for detonation, so as to cause constructive interference between the separate blast waves so to direct the energy more precisely in an intended direction and to direct the fragment cloud main body. Thus the fragment cloud, instead of spreading out all around from the explosion, is directed in a specific direction.

Figure 28:
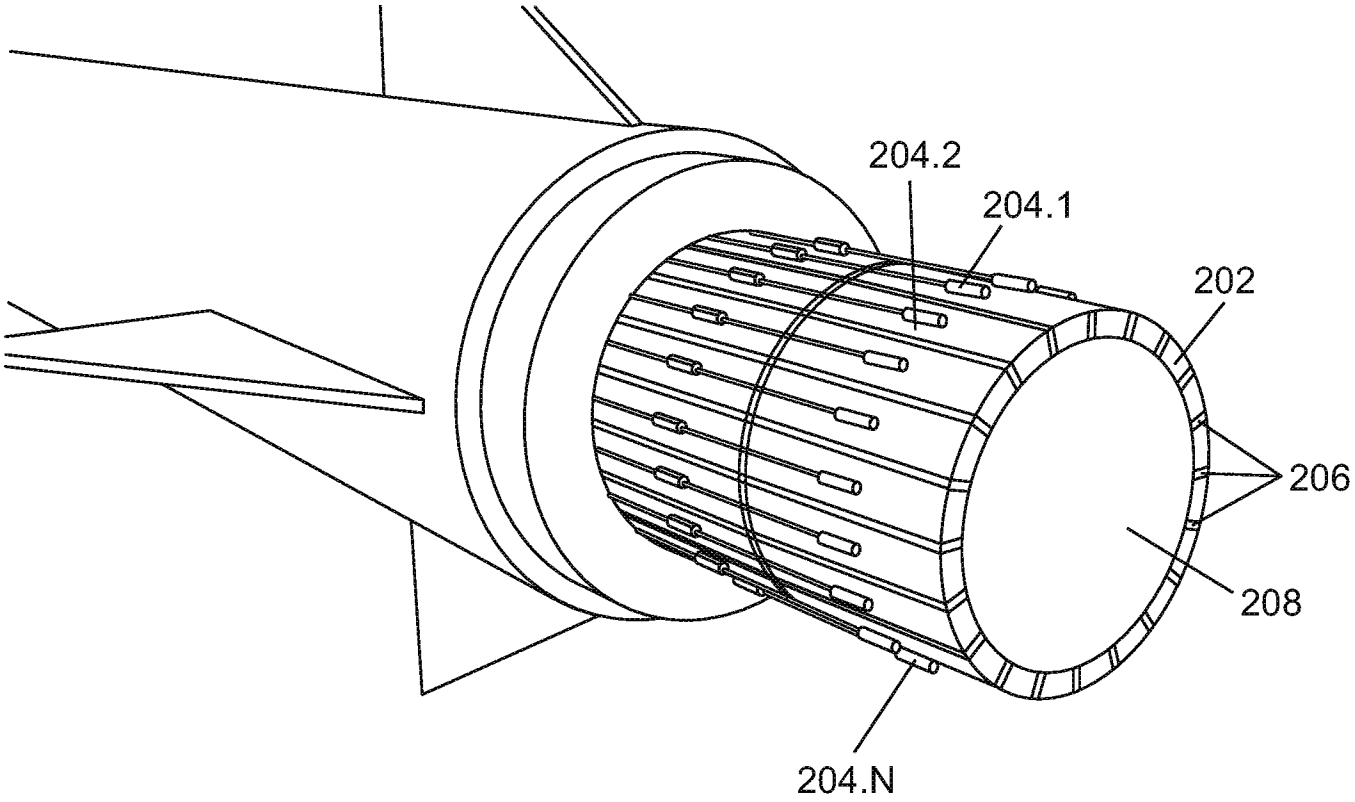

Reference is now made to FIG. 28, which is the same as FIG. 27, which shows detonator ring 202, detonators 204 and spacers 206, and further shows an explosive central core 208 within the ring 202.

Figure 29:
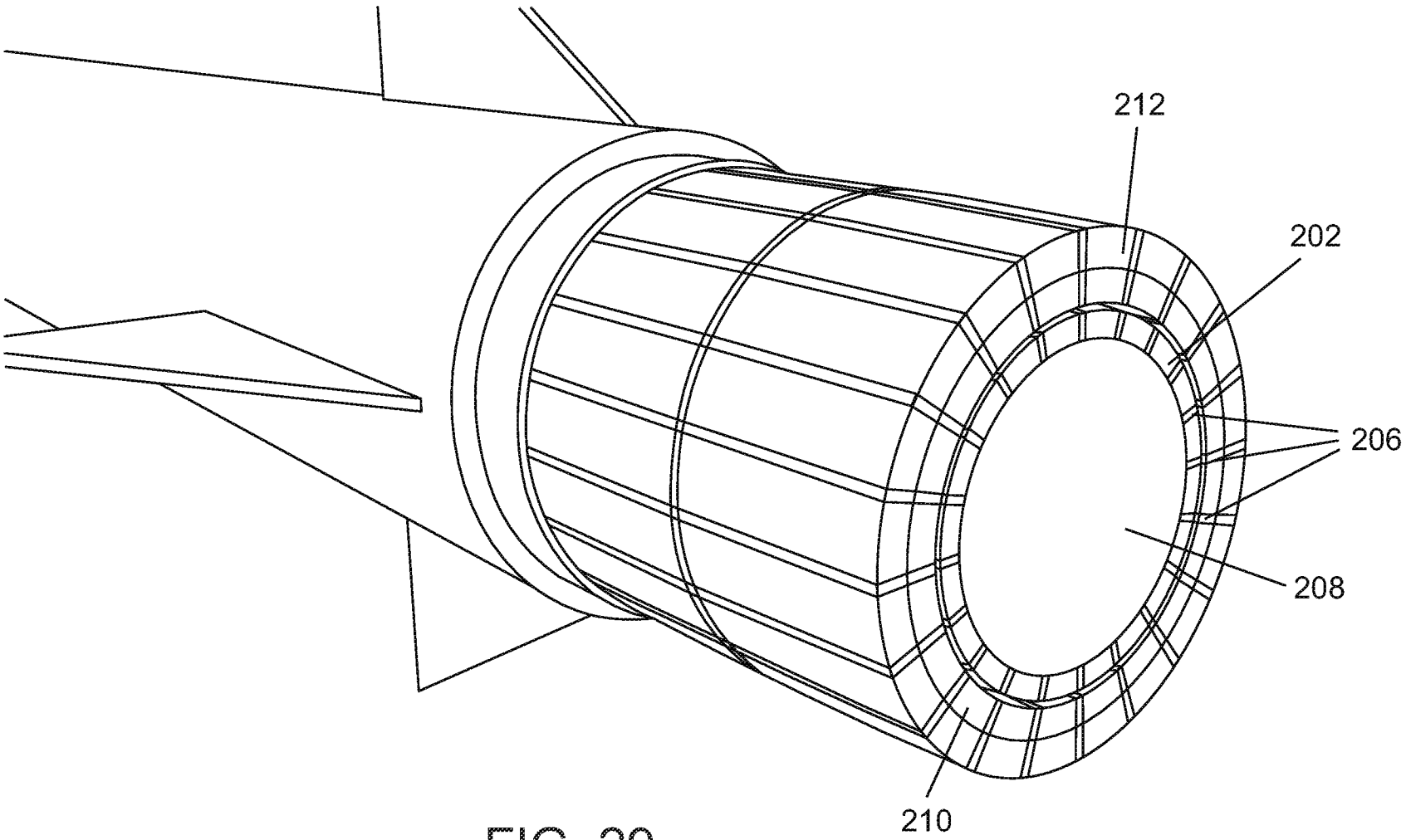

Reference is now made to FIG. 29, which is the same as FIG. 28, having detonator ring 202, spacers 206 and explosive central core 208. Except that the detonators 204 cannot be seen as they are covered by two outer shells 210 and 212 of fragmentation material. Although two outer shells are shown, there may be more or less shells of fragmentation material. It is noted that if for example four or six points are detonated at the right side of the warhead, a blast wave will move towards the left side of the warhead and cause a fragmentation cloud main body to be ejected towards the left.

Figure 30:
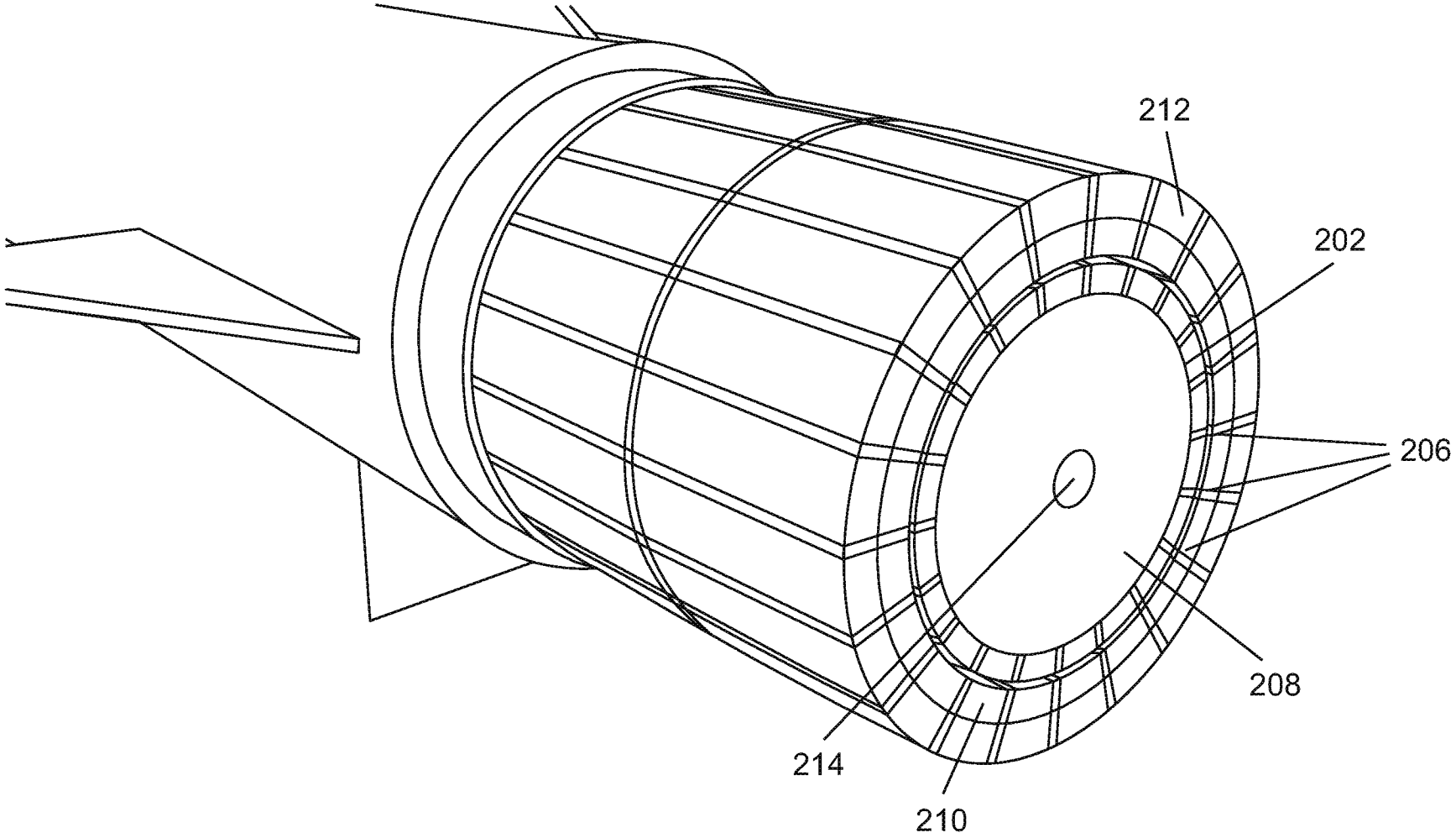

Reference is now made to FIG. 30, which is the same as FIG. 29, having detonator ring 202, spacers 206 and explosive central core 208, and the detonators 204 cannot be seen as they are covered by two outer shells 210 and 212 of fragmentation material. A further detonation point 214 is located at the center of explosive central core. The further detonation point may be used alone for a non-directional blast or may be used in combination with selected detonators from the ring 202 to further help focus the blast. Rather than a single further detonation point, there may be several detonation points placed in the central explosive core 208.

Reference is now made to FIG. 31, which is a simplified cross-sectional view 220 of a further embodiment of the present invention. In the embodiment of FIG. 31, an outer layer of fragmentation material 222 is located over an outer explosive layer 224. The outer explosive layer 224 is located over a ring 226 of detonators separated by spacers as in the previous embodiments. Inner explosive layer 228 underlies all of the layers.

Reference is now made to FIG. 32, which illustrates a further embodiment of the present invention. As before, there is a detonator ring 202, spacers 206 and explosive central core 208, and the detonators 204 of ring 202 cannot be seen as they are covered by two outer shells 210 and 212 of fragmentation material. One or more baffles 230 are located in explosive inner core 208 to guide the detonation in order to focus the blast.

The baffle may act as a deflector to shape or otherwise manipulate the resulting blastwave. The baffle may be constructed of plastic or aluminium or any energy absorbent material that may work to deflect a blastwave. Multiple baffles may help focus the blastwave and the simultaneous use of baffles in the central core in conjunction with separate independent detonations in the ring 202 may allow for more complex and precise focusing or directing of the blast.

Explosions from multiple detonation points may thus be used in the present embodiments to direct the blast in very specific ways, and detonations may be set off in a controlled sequence. Optionally a source of electricity may be located in a part of the warhead intended to explode last, to continue the detonation sequence after other parts of the warhead are destroyed and their functionality no longer available.

Reference is now made to FIG. 33, which is a simplified diagram showing a fragment 240 that may be shaped to capture the blast, indicated by arrows 242, and thus enhance the energy of the fragment cloud. The fragment has a concave shape 244, at least at one side, and a convex shape 246 may optionally be provided on the opposite face. As a result, the concavity 244 may be forced by air flow to face back to the warhead. Accordingly, the concavity 244 may capture blast energy to catapult the fragment to strike the target with increased momentum. The convex front—concave back shape may additionally allow for stabilization in flight, although other shapes may alternatively be used as flight stabilizers. Instead of a convex front 246, a jagged front edge may alternatively be provided, so as to puncture the target and maximize damage.

As in the previous embodiments, a backplate may be located to separate between different segments along the length of the warhead and hence allow different segments to be exploded with independent focus of the blast. Embodiments may provide for the segments to be detonated into two separate explosions to strike the target as it maneuvers as a double explosion.

It is expected that during the life of a patent maturing from this application many relevant detonation, high explosive and missile technologies will be developed and the scopes of the terms herein are intended to include all new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a". "an" and "the" include plural references unless the context clearly dictates otherwise.

It is appreciated that certain features of the invention, which are, for clarity, described in the context of separate embodiments, may also be provided in combination in a single embodiment and the present description is to be construed as if such embodiments are explicitly set forth herein. Conversely, various features of the invention, which are, for brevity, described in the context of a single embodiment, may also be provided separately or in any suitable subcombination or may be suitable as a modification for any other described embodiment of the invention and the present description is to be construed as if such separate embodiments, subcombinations and modified embodiments are explicitly set forth herein. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A warhead comprising an outer shell of explosive surrounding an inner core of fragmentation material wherein said outer shell comprises at least two rings of separately detonatable explosive units, the warhead further comprising a controller configured to select ones of said separately detonatable explosive units for detonation, thereby to provide a directed fragmentation cloud and to control said rings to explode in succession, thereby to provide a shaped fragmentation cloud.

2. The warhead of claim 1, wherein said outer shell comprises at least two rings of separately detonatable explosive units or at least five rings of separately detonatable explosive units.

3. The warhead of claim 2, wherein at least some of said separately controllable explosive units have a concave outer wall, or wherein at least some of said separately controllable explosive units are separated by spacers.

4. The warhead of claim 2, wherein said separately detonatable explosive units are separated respectively by an energy absorbing wall.

5. The warhead of claim 4, wherein said energy-absorbing wall surrounds a respective separately detonatable unit, and is of variable mechanical strength for directing said explosion.

6. The warhead of claim 1, further comprising a separately detonatable backplate, the backplate being located behind said inner core to generate a fragmentation cloud in a forward direction.

7. The warhead of claim 6, wherein said backplate comprises a concave surface towards said inner core.

8. The warhead of claim 6, comprising at least two rings of separately explodable units and having an additional backplate separating said fragmentation core between each ring.

9. The warhead of claim 8, wherein at least some of said backplates comprise an energy-absorbing wall.

10. The warhead of claim 1, wherein said fragmentation core comprises a plurality of shaped particles.

11. The warhead of claim 10, wherein the shaped particles are shaped for self-stabilization in flight.

12. The warhead of claim 1, comprising a controller, said controller being configured to select explodable units for detonation that are on an opposite side of said warhead from said target, thereby to launch fragments of said fragmentation core into a path of a target.

13. A method of interception of a target comprising:

approaching into proximity with said target;

determining a direction in which a weighting of said target as detected by sensors is greater;

causing an explosion to direct energy specifically in said direction wherein said explosion provides a directed fragmentation cloud towards said target, the method comprising directing said fragmentation cloud by selecting for detonation a predetermined set of explosive units from a full set of explosive units disposed around a fragmentation core, wherein said full set of explosive units comprises at least two rings disposed around said fragmentation core, the method comprising detonating said rings successively to shape said fragmentation cloud.

14. The method of claim 13, wherein said full set of explosive units comprises at least five rings successively disposed around said fragmentation core, the method comprising detonating each ring successively.

15. The method of claim 14, comprising detonating a first ring against a first target, maneuvering towards a second target and detonating a second ring towards said second target.

* * * * *